US008342954B2

(12) United States Patent
Oberberger et al.

(10) Patent No.: US 8,342,954 B2
(45) **Date of Patent: *Jan. 1, 2013**

(54) GAMING SYSTEM AND METHOD OF OPERATING A GAMING SYSTEM PROVIDING WAGERING CONTROL FEATURES FOR WAGERING GAMES

(75) Inventors: Michael M. Oberberger, Reno, NV (US); Christiaan R. Champagne, Reno, NV (US)

(73) Assignee: IGT, Reno, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/311,694

(22) Filed: Dec. 6, 2011

(65) Prior Publication Data

US 2012/0077572 A1 Mar. 29, 2012

Related U.S. Application Data

(63) Continuation of application No. 11/864,439, filed on Sep. 28, 2007, now Pat. No. 8,087,999.

(51) Int. Cl.
*A63F 9/24* (2006.01)

(52) U.S. Cl. ..... 463/25

(58) Field of Classification Search ..... 463/25
See application file for complete search history.

(56) References Cited

U.S. PATENT DOCUMENTS

| | | | |
|---|---|---|---|
| 4,223,893 | A | 9/1980 | Shane et al. |
| 4,339,798 | A | 7/1982 | Hedges et al. |
| 4,467,424 | A | 8/1984 | Hedges et al. |
| 4,572,509 | A | 2/1986 | Sitrick |
| 4,760,527 | A | 7/1988 | Sidley |
| 4,893,816 | A | 1/1990 | Levy et al. |
| 5,046,736 | A | 9/1991 | Bridgeman et al. |
| 5,159,549 | A | 10/1992 | Hallman, Jr. et al. |
| 5,167,413 | A | 12/1992 | Fulton |
| 5,560,603 | A | 10/1996 | Seelig et al. |
| 5,580,309 | A | 12/1996 | Piechowiak et al. |
| 5,664,998 | A | 9/1997 | Seelig et al. |
| 5,718,429 | A | 2/1998 | Keller, Jr. |
| 5,755,621 | A | 5/1998 | Marks et al. |
| 5,774,544 | A | 6/1998 | Lee et al. |
| 5,820,460 | A | 10/1998 | Fulton |
| 5,868,392 | A | 2/1999 | Kraft |
| 5,876,284 | A | 3/1999 | Acres et al. |
| 6,012,982 | A | 1/2000 | Piechowiak et al. |
| 6,024,643 | A | 2/2000 | Begis |

(Continued)

FOREIGN PATENT DOCUMENTS

WO WO 98/ 51384 11/1998

(Continued)

OTHER PUBLICATIONS

The rules of backgammon, printed from http://www.bkgm.com/rules.html, on Jun. 23, 2008, available prior to Sep. 28, 2007.

(Continued)

*Primary Examiner* — Corbett B Coburn
(74) *Attorney, Agent, or Firm* — Neal, Gerber & Eisenberg LLP

(57) ABSTRACT

A gaming system and method provides wagering control features for application in multi-stakes, multi-player wagering games. Players have the option to choose one of a plurality of different modes at the beginning of a gaming session. Depending on which mode is selected, the wagering control feature or features available to players during game play will be different.

14 Claims, 25 Drawing Sheets

U.S. PATENT DOCUMENTS

| | | | |
|---|---|---|---|
| 6,128,660 | A | 10/2000 | Grimm et al. |
| 6,146,273 | A | 11/2000 | Olsen |
| 6,309,299 | B1 | 10/2001 | Weiss |
| 6,332,839 | B2 | 12/2001 | Walker et al. |
| 6,371,850 | B1 | 4/2002 | Sonoda |
| 6,406,369 | B1 | 6/2002 | Baerlocher et al. |
| 6,503,145 | B1 | 1/2003 | Webb |
| 6,626,433 | B2 | 9/2003 | Scibetta |
| 6,705,613 | B1 | 3/2004 | Wirth |
| 6,712,702 | B2 | 3/2004 | Goldberg et al. |
| 6,780,110 | B2 | 8/2004 | Baerlocher et al. |
| 6,783,457 | B2 | 8/2004 | Hughs-Baird et al. |
| 6,783,458 | B2 | 8/2004 | Mead et al. |
| 6,808,452 | B2 | 10/2004 | Baerlocher et al. |
| 6,811,484 | B2 | 11/2004 | Katz et al. |
| 6,837,793 | B2 | 1/2005 | McClintic |
| 6,840,856 | B2 | 1/2005 | Stern |
| 6,902,478 | B2 | 6/2005 | McClintic |
| 7,077,744 | B2 | 7/2006 | Cannon |
| 7,097,562 | B2 | 8/2006 | Gagner |
| 7,118,477 | B1 | 10/2006 | Kellen |
| 7,311,598 | B2 | 12/2007 | Kaminkow et al. |
| 7,311,604 | B2 | 12/2007 | Kaminkow et al. |
| 7,314,408 | B2 | 1/2008 | Cannon |
| 7,351,145 | B1 | 4/2008 | Ornstein et al. |
| 7,357,714 | B2 | 4/2008 | Tessmer et al. |
| 2003/0236114 | A1 | 12/2003 | Griswold et al. |
| 2004/0067792 | A1 | 4/2004 | Baerlocher et al. |
| 2005/0003878 | A1 | 1/2005 | Updike |
| 2005/0043088 | A1 | 2/2005 | Nguyen et al. |
| 2005/0043089 | A1 | 2/2005 | Nguyen et al. |
| 2005/0043094 | A1 | 2/2005 | Nguyen et al. |
| 2005/0049049 | A1 | 3/2005 | Griswold et al. |
| 2005/0054437 | A1 | 3/2005 | Baerlocher et al. |
| 2005/0107148 | A1 | 5/2005 | Webb |
| 2005/0261058 | A1 | 11/2005 | Nguyen et al. |
| 2006/0040723 | A1 | 2/2006 | Baerlocher et al. |
| 2006/0040732 | A1 | 2/2006 | Baerlocher et al. |
| 2006/0040733 | A1 | 2/2006 | Baerlocher et al. |
| 2006/0040734 | A1 | 2/2006 | Baerlocher et al. |
| 2006/0040736 | A1 | 2/2006 | Baerlocher et al. |
| 2006/0046822 | A1 | 3/2006 | Kaminkow et al. |
| 2006/0116189 | A1 | 6/2006 | Tessmer et al. |
| 2006/0116200 | A1 | 6/2006 | Leen et al. |
| 2006/0121971 | A1 | 6/2006 | Slomiany et al. |
| 2006/0136297 | A1 | 6/2006 | Willis et al. |
| 2006/0154710 | A1 | 7/2006 | Serafat |
| 2006/0160623 | A1 | 7/2006 | Lee |
| 2006/0189376 | A1 | 8/2006 | Hornik et al. |
| 2006/0229134 | A1 | 10/2006 | Briggs et al. |
| 2006/0252546 | A1 | 11/2006 | Castellari et al. |
| 2006/0259623 | A1 | 11/2006 | Crawford et al. |
| 2007/0021169 | A1 | 1/2007 | Gonen et al. |
| 2007/0021215 | A1 | 1/2007 | Russell et al. |
| 2007/0054732 | A1 | 3/2007 | Baerlocher |
| 2007/0054733 | A1 | 3/2007 | Baerlocher |
| 2007/0060252 | A1 | 3/2007 | Taylor |
| 2007/0072682 | A1 | 3/2007 | Crawford et al. |
| 2007/0077985 | A1 | 4/2007 | Walker et al. |
| 2007/0077990 | A1 | 4/2007 | Cuddy et al. |
| 2007/0082725 | A1 | 4/2007 | Low et al. |
| 2007/0093291 | A1 | 4/2007 | Hulvey |
| 2007/0093294 | A1 | 4/2007 | Serafat et al. |
| 2007/0126186 | A1 | 6/2007 | Crawford et al. |
| 2007/0149292 | A1 | 6/2007 | Kaminkow et al. |
| 2007/0155485 | A1 | 7/2007 | Cuddy et al. |
| 2007/0167217 | A1 | 7/2007 | Kaminkow et al. |
| 2007/0265092 | A1 | 11/2007 | Betteridge |
| 2008/0032764 | A1 | 2/2008 | Cannon |

FOREIGN PATENT DOCUMENTS

| | | |
|---|---|---|
| WO | WO 2004/046859 | 6/2004 |
| WO | WO 2004/069356 | 8/2004 |
| WO | WO 2005/082480 | 9/2005 |
| WO | WO 2005/094347 | 10/2005 |
| WO | WO 2006/020811 | 2/2006 |
| WO | WO 2006/116501 | 11/2006 |
| WO | WO 2007/034212 | 3/2007 |
| WO | WO 2007/041163 | 4/2007 |
| WO | WO 2007/044655 | 4/2007 |
| WO | WO 2007/044908 | 4/2007 |

OTHER PUBLICATIONS

Backgammon Rules—The Doubling Cube, printed from http://www.backgammon.org.il/backgammon-doubling-cube.php on Jun. 23, 2008, available prior to Sep. 28, 2007.

FIG. 4C

300

| SUMMARY OF WAGERS PLACED | | | | | |
|---|---|---|---|---|---|
| | Blinds | 1st Betting Round After Hole Cards Dealt | 2nd Betting Round After Flop Card Dealt | 3rd Betting Round After Turn Card Dealt | 4th Betting Round After River Card Dealt |
| Player 1 (Dealer) | 10 | Checks | | | |
| Player 2 | 5 | 5 | | | |
| Total in Pot | 15 | 20 | | | |
| Player in Control of Raising When Betting Round Ends | Either 1 OR 2 | Either 1 OR 2 | | | |

FIG. 5C

300

| SUMMARY OF WAGERS PLACED | | | | | |
|---|---|---|---|---|---|
| | Blinds | 1st Betting Round After Hole Cards Dealt | 2nd Betting Round After Flop Card Dealt | 3rd Betting Round After Turn Card Dealt | 4th Betting Round After River Card Dealt |
| Player 1 (Dealer) | 10 | Checks | Raises 20 | | |
| Player 2 | 5 | 5 | Checks/ Accepts Raise of 20 | | |
| Total in Pot | 15 | 20 | 60 | | |
| Player in Control of Raising When Betting Round Ends | Either 1 OR 2 | Either 1 OR 2 | Player 2 | | |

FIG. 6C

300

| SUMMARY OF WAGERS PLACED | | | | | |
|---|---|---|---|---|---|
| | Blinds | 1st Betting Round After Hole Cards Dealt | 2nd Betting Round After Flop Card Dealt | 3rd Betting Round After Turn Card Dealt | 4th Betting Round After River Card Dealt |
| Player 1 (Dealer) | 10 | Checks | Raises 20 | Accept Raise of 40 | |
| Player 2 | 5 | 5 | Checks/ Accepts Raise of 20 | Raises 40 | |
| Total in Pot | 15 | 20 | 60 | 140 | |
| Player in Control of Raising When Betting Round Ends | Either 1 OR 2 | Either 1 OR 2 | Player 2 | Player 1 | |

FIG. 7C

300

| SUMMARY OF WAGERS PLACED | | | | | |
|---|---|---|---|---|---|
| | Blinds | 1st Betting Round After Hole Cards Dealt | 2nd Betting Round After Flop Card Dealt | 3rd Betting Round After Turn Card Dealt | 4th Betting Round After River Card Dealt |
| Player 1 (Dealer) | 10 | Checks | Raises 20 | Accept Raise of 40 | Raises 40 |
| Player 2 | 5 | 5 | Checks/ Accepts Raise of 20 | Raises 40 | Checks/ Accepts Raise of 40 |
| Total in Pot | 15 | 20 | 60 | 140 | 220 |
| Player in Control of Raising When Betting Round Ends | Either 1 OR 2 | Either 1 OR 2 | Player 2 | Player 1 | Player 2 |

FIG. 9C

300

| SUMMARY OF WAGERS PLACED | | | | | |
|---|---|---|---|---|---|
| | Blinds | 1st Betting Round After Hole Cards Dealt | 2nd Betting Round After Flop Card Dealt | 3rd Betting Round After Turn Card Dealt | 4th Betting Round After River Card Dealt |
| Player 1 (Dealer) | 10 | Checks | | | |
| Player 2 | 5 | 5 | | | |
| Total in Pot | 15 | 20 | | | |

FIG. 10C

300

| SUMMARY OF WAGERS PLACED | | | | | |
|---|---|---|---|---|---|
| | Blinds | 1st Betting Round After Hole Cards Dealt | 2nd Betting Round After Flop Card Dealt | 3rd Betting Round After Turn Card Dealt | 4th Betting Round After River Card Dealt |
| Player 1 (Dealer) | 10 | Checks | Proposes Raise of 20 | | |
| Player 2 | 5 | 5 | Checks/ Rejects the Raise of 20 | | |
| Total in Pot | 15 | 20 | 20 | | |

FIG. 11C

300

| SUMMARY OF WAGERS PLACED | | | | | |
|---|---|---|---|---|---|
| | Blinds | 1st Betting Round After Hole Cards Dealt | 2nd Betting Round After Flop Card Dealt | 3rd Betting Round After Turn Card Dealt | 4th Betting Round After River Card Dealt |
| Player 1 (Dealer) | 10 | Checks | Proposes Raise of 20 | Accepts the Raise of 20 | |
| Player 2 | 5 | 5 | Checks/ Rejects the Raise of 20 | Proposes Raise of 20 | |
| Total in Pot | 15 | 20 | 20 | 60 | |

FIG. 12C

300

| SUMMARY OF WAGERS PLACED | | | | | |
|---|---|---|---|---|---|
| | Blinds | 1st Betting Round After Hole Cards Dealt | 2nd Betting Round After Flop Card Dealt | 3rd Betting Round After Turn Card Dealt | 4th Betting Round After River Card Dealt |
| Player 1 (Dealer) | 10 | Checks | Proposes Raise of 20 | Accepts the Raise of 20 | Rejects the Raise of 40 |
| Player 2 | 5 | 5 | Checks/ Rejects the Raise of 20 | Proposes Raise of 20 | Proposes Raise of 40 |
| Total in Pot | 15 | 20 | 20 | 60 | 60 |

GAMING SYSTEM AND METHOD OF OPERATING A GAMING SYSTEM PROVIDING WAGERING CONTROL FEATURES FOR WAGERING GAMES

PRIORITY CLAIM

This application is a continuation application of, claims priority to and the benefit of U.S. patent application Ser. No. 11/864,439, filed on Sep. 28, 2007, which issued as U.S. Pat. No. 8,087,999 on Jan. 3, 2012, the contents of which are incorporated by reference herein.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Backgammon is one the oldest games in the world. In certain versions, backgammon is a wagering game which combines elements of chance and skill. In backgammon, two players play against each other for a stake. The stake is not limited to being actual money, and in some cases, the stakes includes one or more points. One way that the stake can change in a game of backgammon is through the use of a doubling cube. The doubling cube is typically used when playing in backgammon tournaments or games over the Internet. The doubling cube provides a way to raise the stakes of a game.

During a game of backgammon, a first player who thinks that she has the advantage can turn the doubling cube and announce a double. This can be done at the start of the first player's turn and before the dice have been rolled. If the second player refuses the double, the second player immediately loses the current stake and game play ends. If the second player accepts the double, the stakes are doubled, and the second player becomes the owner of the doubling cube. That is, the second player has the exclusive right to announce the next double.

If the course of the game changes, and the owner of the doubling cube judges that he has the advantage in the game, he can announce another double. If the first player refuses the double, she now loses the doubled stake. On the other hand, if the first player accepts the double, the game goes on with stakes that are four times the original value.

In backgammon, being the owner of the doubling cube provides that player certain power in the game. A player in possession of the doubling cube can use it to force his opponent to make the decision of whether to concede the game at the current stakes or continue to play the game for double the stakes and at a decided disadvantage. There is no limit to how many times the stake can be doubled in backgammon. However, the right to announce a raise or double switches from one player to the other every time it is exercised. Thus, one player cannot constantly raise the stakes of the game.

Other wagering games include mechanisms through which players can force their opponents to make tough wagering choices, such as whether to continue game play at heightened stakes or forfeit the game. Poker is one example. In a game of poker, players can makes raises by betting. A player's opportunity to win in a game of poker is limited by his ability to match the amounts wagered by his opponents. Having a large bankroll is an advantage in poker because a player often makes betting decisions in the game based on the size of his chip stack in relation to his opponent's chip stack. As is often the case, players with less money are forced out of games by excessive wagering or raising by other players with larger bankrolls.

The popularity of many wagering game depends on its ability to attract casual participants, as well as more serious players. Casual players or players who have less experience or less money to back up their wagering activities may be hesitant to play against other players with higher levels of skill and/or larger bankrolls. It is desirable to provide wagering games that appeal to a wide range of players having disparate backgrounds, skills, and interest levels, as well as different bankroll sizes.

Accordingly, there is an existing need to provide different wagering control features which can be used in wagering games to avoid situations where players are betting more than they wish to risk and to enable players to continue playing a game when they otherwise may have folded.

SUMMARY

The present disclosure generally relates to gaming systems, gaming devices, and methods providing wagering games. More particularly, the present disclosure provides wagering control features for multi-stakes, multi-player wagering games. One embodiment of the present disclosure provides a gaming system including a central server, central controller, or remote host configured to communicate with or link to a plurality of gaming devices. Each of the gaming devices includes at least one game operable upon a wager by a player. In one embodiment, the gaming system enables players playing at the individual gaming devices to play against one another in the same game in a head-to-head gaming environment.

In one embodiment, at the beginning of a multi-player gaming session, players have the option to choose a first risk mode or a second different risk mode. In one such embodiment, after the players playing at the gaming devices specify their preferred risk modes, the central controller matches players to compete against one another based at least in part on the risk modes selected by the players. It should be appreciated that, in certain embodiments, other factors may also be considered when matching players for competitive play. For example, in addition to compatible risk mode selections, players may be matched based on: (i) compatible selections of wager level; (ii) compatible selections of the type of wagering game the players wish to play; (iii) player status (e.g., determined through a player tracking system); (iv) any other suitable criteria; or (v) any combination of these.

In one embodiment, players have the option to choose a high risk mode or a low risk mode for game play. Once players are matched up for game play, the wagering control feature or features available to those players during the wagering game will be different depending on the risk mode selected by the players.

In one such embodiment, the wagering game includes a plurality of opportunities at which raises can be made to raise the value or stakes of the game. In one such embodiment, at a first one of the opportunities, any of the players can make a first raise in the play of the game. In one embodiment, if the competing players have chosen the high risk mode of play and a first one of the players makes the first raise in the game, a second one of the players can accept or reject the first raise. If the second one of the players rejects the first raise, the play of the game terminates as to the second player. In other words, by rejecting the proposed raise, the second player forfeits the game. If the second one of the players accepts the first raise, the stakes of the game increase. In addition, the second player obtains the exclusive right to propose the next raise. That is, the first player cannot make another raise in the game until the second player has made a raise for the entire play of the game. When no more betting is possible, the gaming system determines which of the players is the winner and provides an award to the winner based on the current stakes or value of the game.

In one example embodiment which includes a poker game, a first player and a second player each select the high risk mode at their respective gaming devices. The players are matched up for competitive game play based at least in part on their compatible selections of high risk mode. Upon initiation of a play of the poker game, each player is dealt a hand of cards. After the initial deal, a first round of betting occurs. If the first player chooses to make a raise during the first round of betting, the second player must accept the raise to remain in the game. In other words, if the second player does not match the raise, the second player folds. If the second player accepts the raise, the betting round ends, and only the second player can make the next raise in the game. The first player cannot propose another raise until the second player has raised. Thus, in this example where the competing players have chosen high risk mode, the ability to make a raise alternates from one player to another. This high risk mode wagering control feature prevents one player from repeatedly raising and forcing the other player out of the play of the game.

It should be appreciated that, in one embodiment, the wagering control feature only allows one bet or raise in each betting round. That is, no re-raises are permitted in a single betting round. By simplifying the betting in a competitive game, such as poker, to a single bet per player per round, the game is able to play at a much faster rate which is desirable by both players and operators.

As discussed above, in certain embodiments, players have the option to choose a low risk mode for the wagering game instead of choosing the high risk mode. In one embodiment in which the competing players choose the low risk mode of play, each time an opportunity to make a raise presents itself in the game, a first one of the players can propose a raise. If a first one of the players chooses to make a raise at one of the opportunities, a second one of the players can accept or reject the raise. If the second one of the players accepts the raise, the value of the game or pot increases, and the players continue playing the game. If the second one of the players rejects the raise, that player can continue participating in the play of the game, but the value of the game or pot does not increase. After a final one of the opportunities, the winner is identified. The winner is provided with an award based on the value of the game after the final one of the opportunities. Thus, in one embodiment, the low risk mode wagering control feature enables players who decline raise actions proposed by their opponents to continue playing the wagering game without penalty.

In one embodiment, the wagering control feature offered in any selected mode of play takes the form of a displayable visible token. In such embodiments, when a player perceives an advantage to do so, that player can take control of or activate the token to use the wagering control feature in a play of the game. In certain embodiments, the token is passed back and forth between opponents depending on the risk mode. In one embodiment, any of the players participating in the game can be the first player to use the token. In another embodiment, a player must earn the opportunity to use the token by satisfying a suitable qualifying condition. In various alternative embodiments, the token includes any suitable type of indication displayed on a display device of a gaming machine or a button on a gaming machine. For example, a gaming machine may include a raise button, which becomes illuminated or otherwise indicates to a player when that player has the ability to make a raise during the course of the wagering game.

In certain embodiments, the risk modes selected by players may impose limits on the possible wager amounts for a wagering game. This reduces the threat of a large opponent bankroll and reduces the volatility of a game.

It should be appreciated that the wagering control features described herein may be applied to any wagering game, including but not limited to poker, slot, blackjack, baccarat, craps, bingo, keno, and any other suitable wagering game. The game could also be any suitable wagering game developed in the future which is operable upon a wager by a player and which is operable to provide an award to the player. The wagering control features of the present disclosure are particularly well-suited for application in a wagering game having a multi-stage format, where a player's chance of winning may dramatically change with each stage. For example, in a game of Blackjack, at each stage of a play of a Blackjack game, a separate bet can be placed based on the player's chance of winning at a given stage.

It is therefore an advantage of the present disclosure to provide a game wherein risk of play is lowered and game play is resolved quicker.

Another advantage of the present disclosure is to create a casual wagering environment wherein players of disparate backgrounds, skills, and interest levels can wager against each other in mutually set parameters.

A further advantage of the present disclosure is to provide wagering control features for application in head-to-head wagering games.

Additional features and advantages of the disclosed embodiments are described in, and will be apparent from, the following Detailed Description of the Invention and the Figures.

BRIEF DESCRIPTION OF THE FIGURES

FIGS. 4A, 4B, and 4C illustrate an example first betting round of a play of a Texas Hold 'Em poker game employing a high risk mode wagering control feature.

FIGS. 5A, 5B, and 5C illustrate an example second betting round of a play of a Texas Hold 'Em poker game employing a high risk mode wagering control feature.

FIGS. 6A, 6B, and 6C illustrate an example third betting round of a play of a Texas Hold 'Em poker game employing a high risk mode wagering control feature.

FIGS. 7A, 7B, and 7C illustrate an example fourth betting round of a play of a Texas Hold 'Em poker game employing a high risk mode wagering control feature.

FIGS. 9A, 9B, and 9C illustrate an example first betting round of a play of a Texas Hold 'Em poker game employing a low risk mode wagering control feature.

FIGS. 10A, 10B, and 10C illustrate an example second betting round of a play of a Texas Hold 'Em poker game employing a low risk mode wagering control feature.

FIGS. 11A, 11B, and 11C illustrate an example third betting round of a play of a Texas Hold 'Em poker game employing a low risk mode wagering control feature.

FIGS. 12A, 12B, and 12C illustrate an example fourth betting round of a play of a Texas Hold 'Em poker game employing a low risk mode wagering control feature.

DETAILED DESCRIPTION

The present disclosure may be implemented in various configurations for gaming machines or gaming devices, including but not limited to: (1) a dedicated gaming machine or gaming device, wherein the computerized instructions for controlling any games (which are provided by the gaming machine or gaming device) are provided with the gaming machine or gaming device prior to delivery to a gaming establishment; and (2) a changeable gaming machine or gaming device, where the computerized instructions for controlling any games (which are provided by the gaming machine or gaming device) are downloadable to the gaming machine or gaming device through a data network when the gaming machine or gaming device is in a gaming establishment. In one embodiment, the computerized instructions for controlling any games are executed by at least one central server, central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
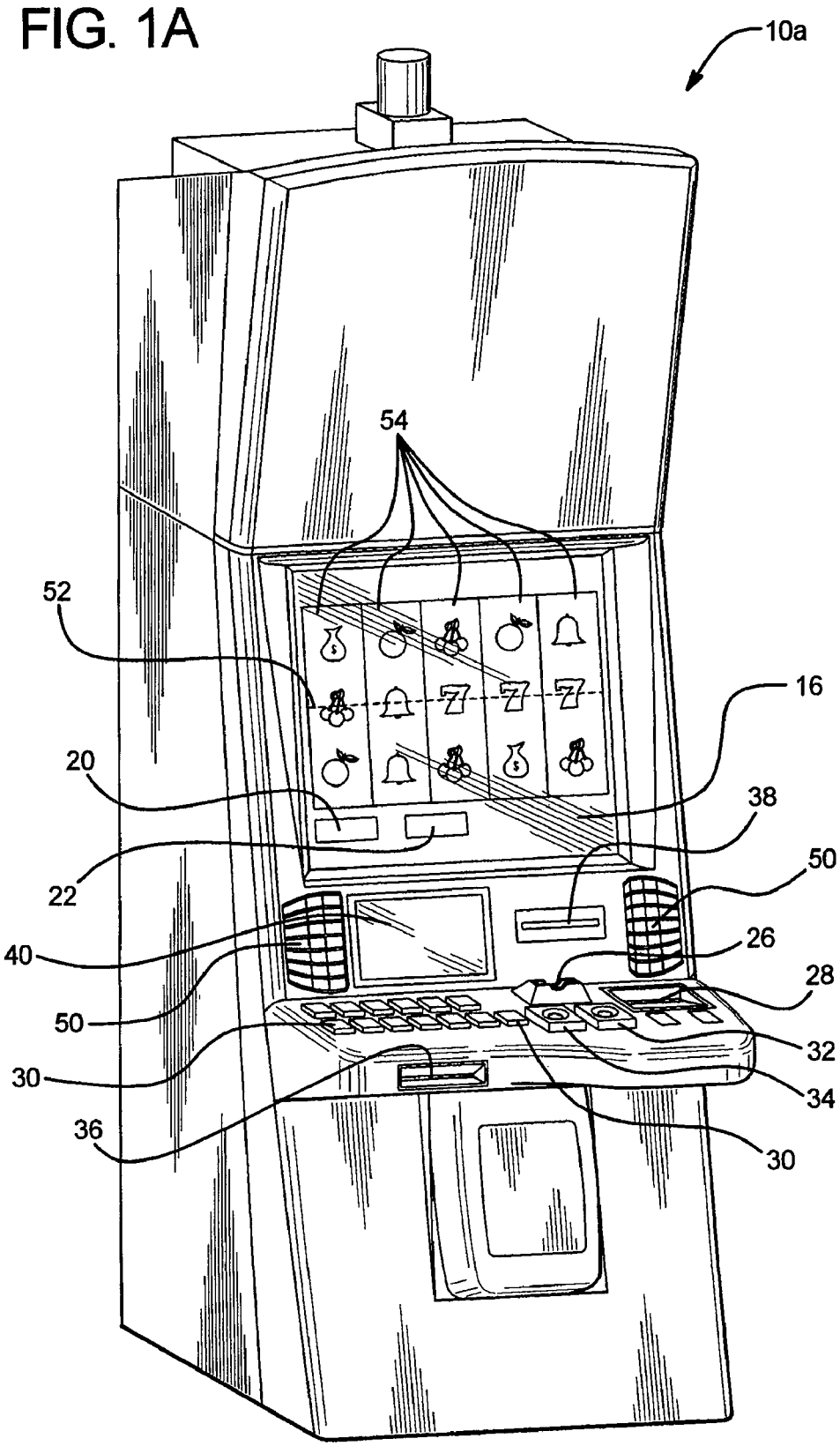
FIGS. 1A and 1B are perspective views of example alternative embodiments of the gaming device of the present disclosure.
Figure 1B:
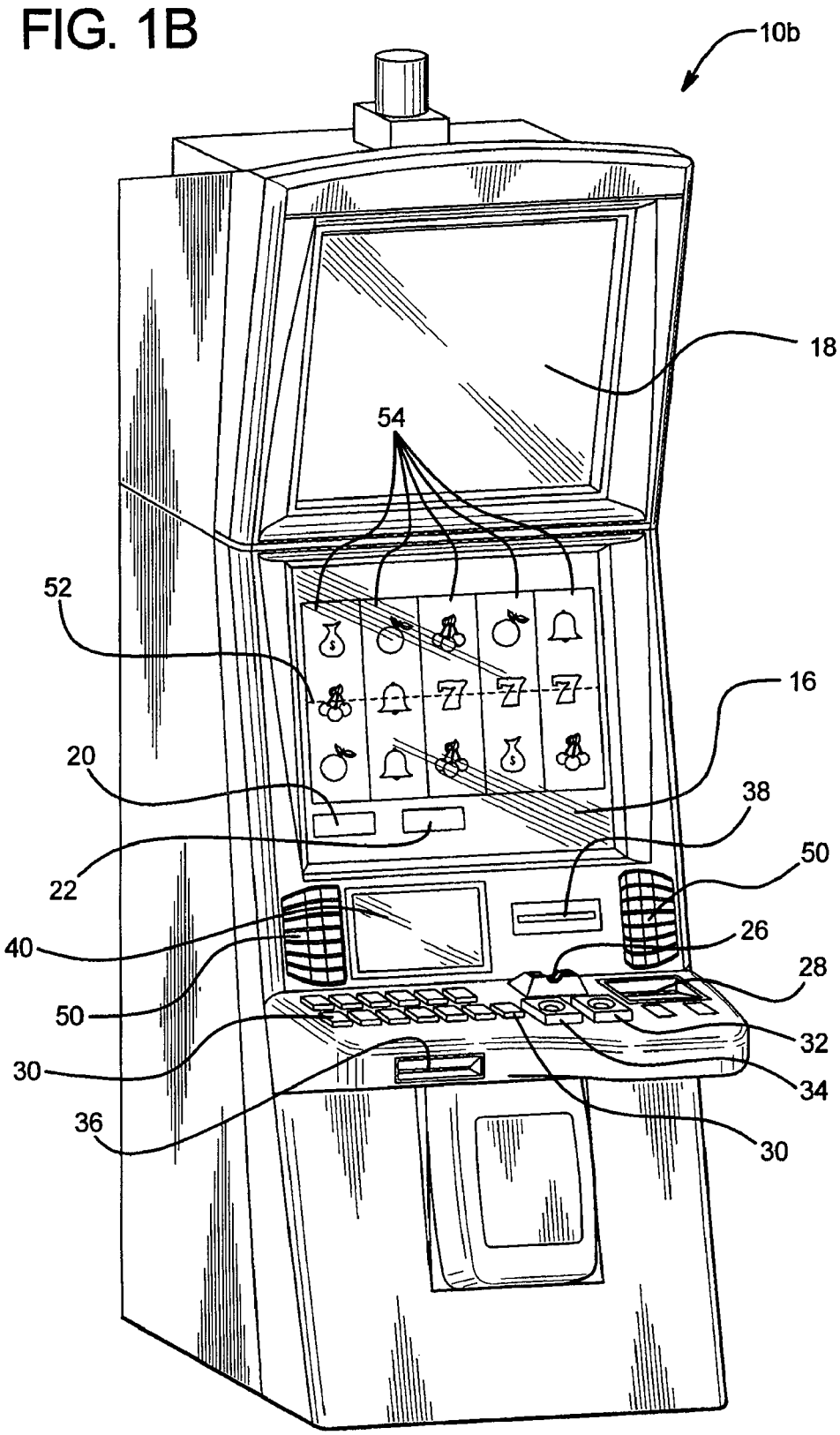

Referring now to the drawings, two example alternative embodiments of the gaming device of the disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
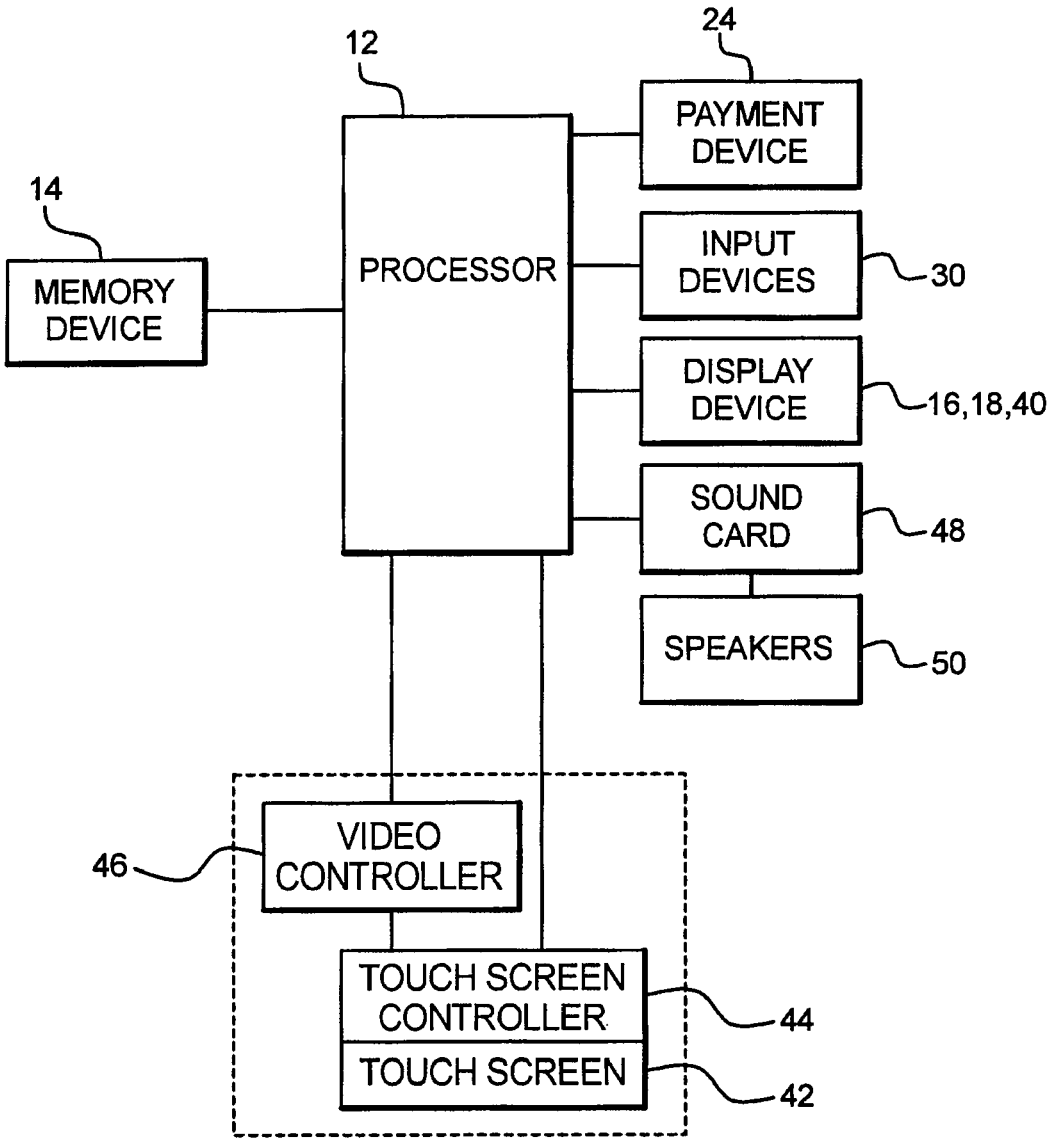
FIG. 2A is a schematic block diagram of one embodiment of an electronic configuration for one of the gaming devices disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming device or gaming machine disclosed herein is operable over a wireless network, such as part of a wireless gaming system. In this embodiment, the gaming machine may be a hand held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance or the equivalent. In one embodiment, the gaming device includes a bet display 22 which displays a player's amount wagered. In one embodiment, as described in more detail below, the gaming device includes a player tracking display 40 which displays information regarding a player's playing tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one or a plurality of game or other suitable images, symbols or indicia.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals (or related data) and other relevant information. In another embodiment, a player may carry a portable device, such as a cell phone, a radio frequency identification tag or any other suitable wireless device, which communicates a player's identification, credit totals (or related data) and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card may be implemented in accordance with the gaming device disclosed herein.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places. One such input device is a conventional touch-screen button panel.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering primary or base game. The gaming machine or device may include some or all of the features of conventional gaming machines or devices. The primary or base game may comprise any suitable reel-type game, card game, cascading or falling symbol game, number game or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, display the plurality of simulated video reels 54. Each reel 54 displays a plurality of indicia or symbols, such as bells, hearts, fruits, numbers, letters, bars or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device with wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels, modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more or each of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to being based on how many paylines that would have passed through each of the strings of related symbols in active symbol positions).

In one embodiment, a base or primary game may be a poker game wherein the gaming device enables the player to play a conventional game of video draw poker and initially deals five cards all face up from a virtual deck of fifty-two card deck. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

In one embodiment, a base or primary game may be a keno game wherein the gaming device displays a plurality of selectable indicia or numbers on at least one of the display devices. In this embodiment, the player selects at least one or a plurality of the selectable indicia or numbers via an input device such as the touch screen. The gaming device then displays a series of drawn numbers to determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition may be by exceeding a certain amount of game play (such as number of games, number of credits, amount of time), or reaching a specified number of points earned during game play.

In another embodiment, the gaming device processor 12 or central server 56 randomly provides the player one or more plays of one or more secondary games. In one such embodiment, the gaming device does not provide any apparent reasons to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game is accomplished through a simple "buy in" by the player, for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
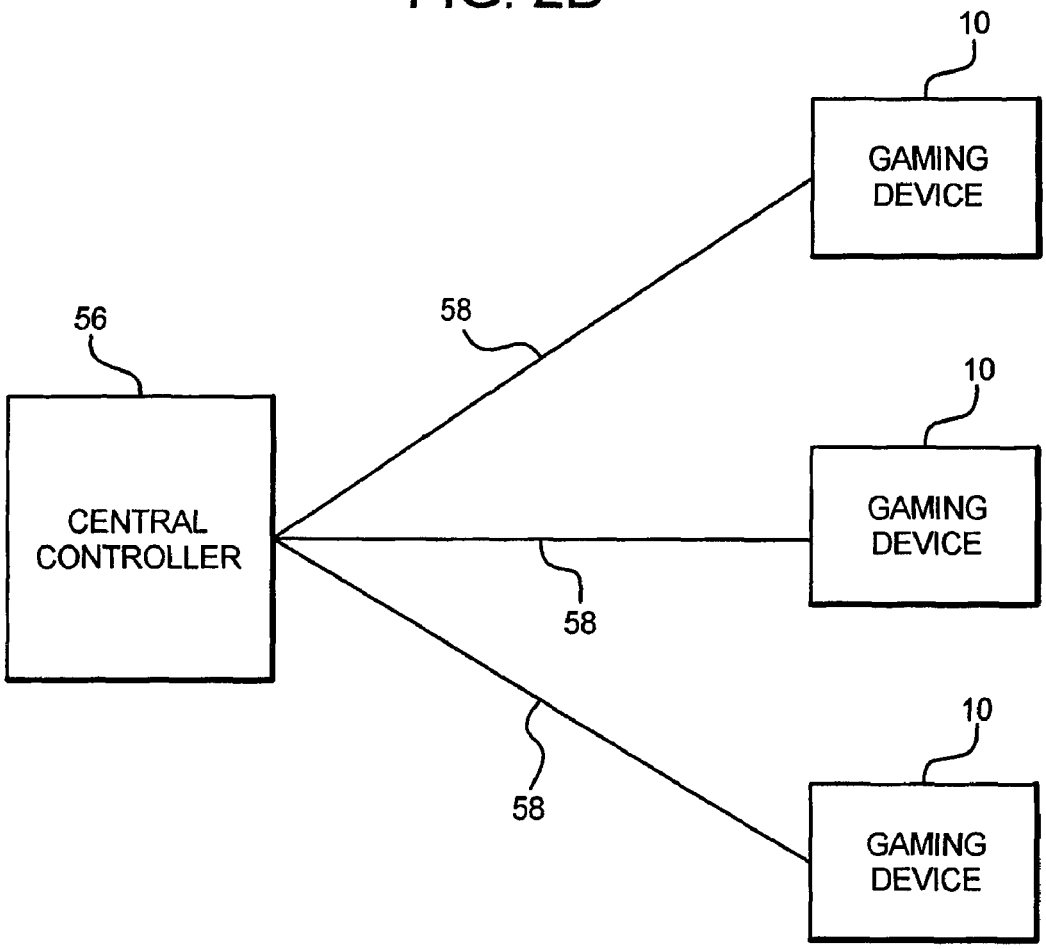
FIG. 2B is a schematic block diagram of one embodiment of a network configuration for a plurality of gaming devices disclosed herein.

In one embodiment, as illustrated in FIG. 2B, one or more of the gaming devices 10 are in communication with each other and/or at least one central server, central controller or remote host 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central server is designed to transmit and receive events, messages, commands or any other suitable data or signal between the central server and each of the individual gaming devices. The central server processor is operable to execute such communicated events, messages or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, a predetermined game outcome value is determined for each of a plurality of linked or networked gaming devices based on the results of a bingo, keno or lottery game. In this embodiment, each individual gaming device utilizes one or more bingo, keno or lottery games to determine the predetermined game outcome value provided to the player for the interactive game played at that gaming device. In one embodiment, the bingo, keno or lottery game is displayed to the player. In another embodiment, the bingo, keno or lottery game is not displayed to the player, but the results of the bingo, keno or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of if the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any players gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts and/or the time these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator is available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Wagering Control Features for Wagering Games

Figure 3A:
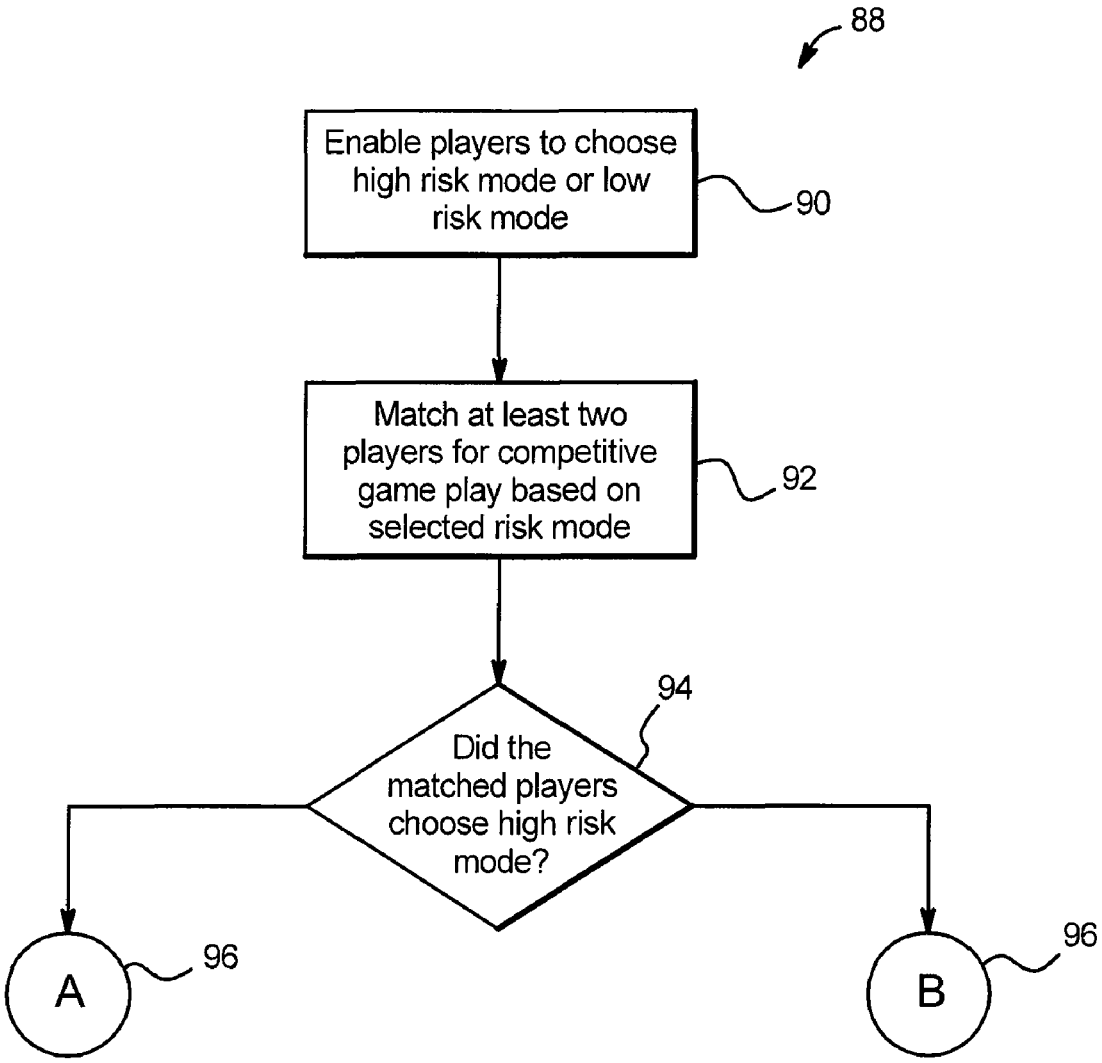
FIGS. 3A, 3B, and 3C provide flow diagrams illustrating an embodiment of the present disclosure in which players have the option to choose a high risk mode or a low risk mode at the beginning of a gaming session.

Referring now to FIG. 3A, one embodiment of the present disclosure operates according to sequence 88. In one embodiment, a plurality of the gaming devices are in communication with or linked to a central controller, central server or remote host to form a gaming system. Another embodiment of the present invention provides a gaming system having a plurality of linked gaming devices where one of the gaming devices functions as the central server or controller. Each of the gaming devices of the gaming system includes at least one wagering game operable upon a wager by a player. The central, controller, central server or remote host may be any suitable server or computing device which at least includes a processor and a memory or storage device. The central controller: (a) stores a plurality of different commands, instructions or other communications and is operable to cause the execution of these commands on display devices of the gaming machines which act as a "thin client," (b) stores a plurality of different commands, instructions or other communications, such as game programs, and sends one or more of the commands, instructions or other communications to each gaming machine and the individual gaming machines execute the received commands and therefore act as a "thick client" and/or (c) stores a plurality of different commands, instructions or other communications, such as game programs, and sends one or more of the different commands, instructions or other communications to each gaming machine and the individual gaming machines execute the received commands upon a further command from the central controller. In another embodiment, the central controller communicates with a plurality of computers over the internet and enables the wagering game to be played over the Internet or other suitable data network. It should be appreciated that the gaming system may include any suitable combination of communication and game control between the central controller and the individual gaming machines to execute game play.

In one embodiment of the present disclosure, players playing at the gaming devices of the gaming system are enabled to choose one of a plurality of modes of play at the beginning of their gaming sessions. In one such embodiment, the modes of play relate to skill level. For example, the players playing at the gaming devices of the gaming system are enabled to choose a beginner mode or an expert mode. In another embodiment, players may choose a mode of play based on a desired level of risk. In one such embodiment, the players are enabled to choose one of a plurality of risk modes, including at least a first risk mode and a different second risk mode. In some embodiments, players can set up accounts which keep track of player preferences regarding game play, such as a player's preferred mode of play.

As indicated by block 90 in FIG. 3A, in one embodiment, players playing at the gaming devices of the gaming system are enabled to choose either a high risk mode or a low risk mode at the beginning of their gaming sessions. After receiving the players' selections for the mode of play, the controller matches players to compete against one another in a play of the wagering game based at least in part on the selected modes, as indicated by block 92. In one embodiment, the gaming system enables two players playing at or with individual gaming devices to compete against one another in the same wagering game in a head-to-head gaming environment. In one such embodiment, players can use handheld devices (or other communication devices) to participate in the competitive gaming experience of the present disclosure. In one embodiment, the handheld device is a wireless device that includes any suitable combination of displays, inputs, controls and other features of a conventional gaming device. In an alternative embodiment, rather than having two players competing against one another in a game, a player playing at a gaming device may choose to play the game against a computer. In a further alternative embodiment, more than two players may be able to play the wagering game.

In some embodiments, in addition to compatible risk modes, other factors are considered when matching players to compete in a play of the wagering game. In one embodiment, players may be required to make one or more other game selections which are taken into account when matching players for game play. In one such embodiment, players must choose a compatible wager level, such as a minimum bet amount or a maximum allowable bet, to be matched up for game play. In another embodiment, players must choose to play the same type of wagering game. In other embodiments, players are not required to play the same game in order to compete against one another.

In one embodiment, players playing at individual gaming devices who have selected the same mode of play are randomly matched up for competitive play. For example, if four players—Player 1, Player 2, Player 3, and Player 4—each select high risk mode for a first play of the game, the central controller randomly determines to match Player 1 with Player 3, and Player 2 with Player 4 for that play of the game. In one embodiment, each player is randomly re-matched with another player after each play of the game. For example, if Players 1, 2, 3, and 4 decide to play a second round of the game, the central controller randomly determines to match Player 1 with Player 2 and Player 3 with Player 4 for the second play of the game. In other embodiments, players are randomly re-matched after a plurality of plays of the game or after a designated amount of time. Re-matching players in this manner helps to prevent players from cheating in the game. This helps prevent collusion amount players and working with a team of spotters in the gaming establishment or casino.

In one embodiment, players can choose a risk mode at the beginning of each play of the game. In one such embodiment, players can switch their selected risk mode at any time between game plays. In another embodiment, once a player selects a risk mode, the selected risk mode is applied to a plurality of plays of the game.

As indicated by diamond 94, if the determination is made that the matched players selected high risk mode, sub-sequence A is executed, as indicated by block 96.

Figure 3B:
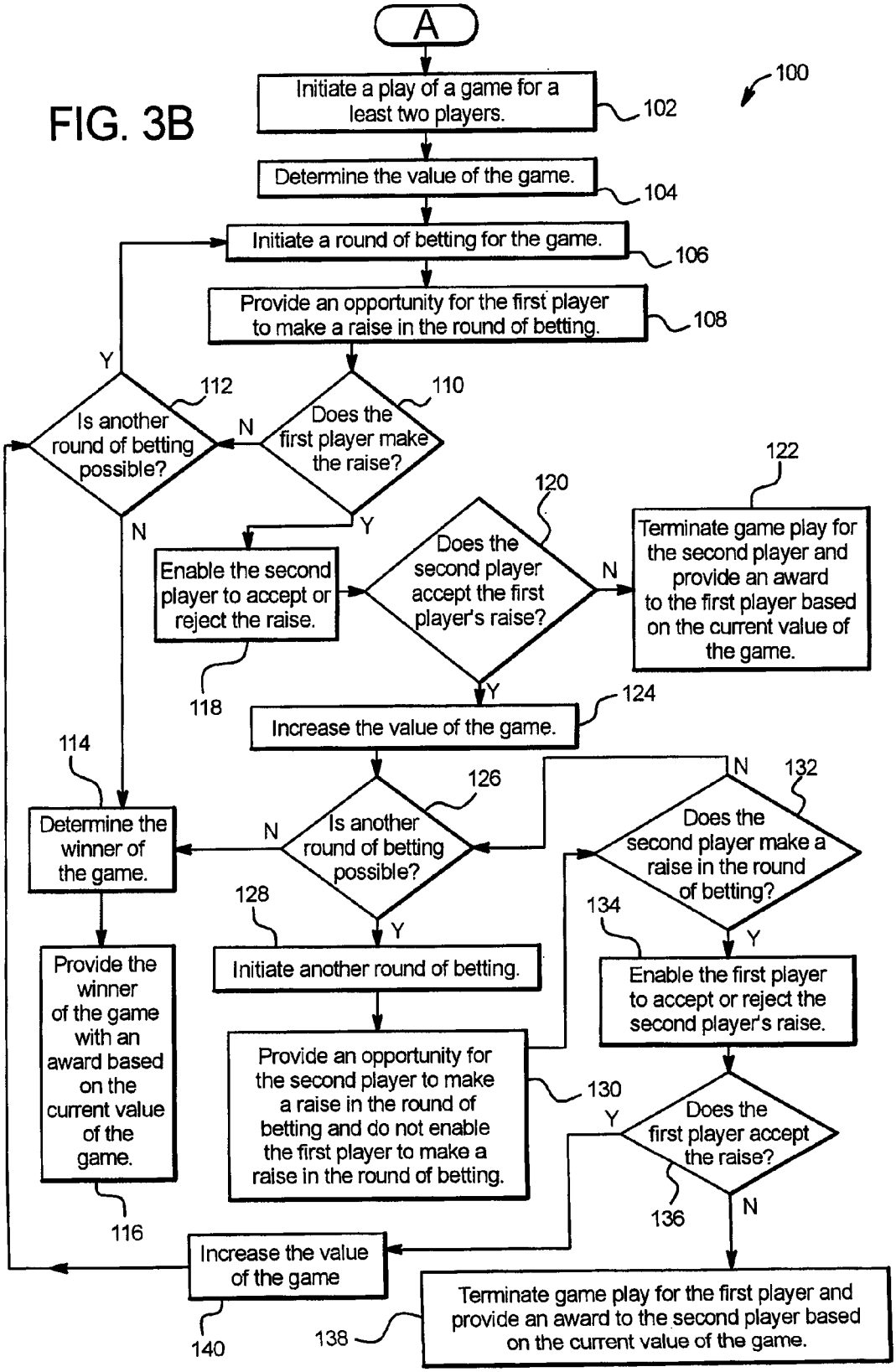

Referring now to FIG. 3B, a play of the wagering game employing high risk mode operates according to sub-sequence A 100. The controller initiates a play of the wagering game, as indicated by block 102. In one embodiment, the play of the wagering game begins upon the players placing initial wagers. In certain embodiments, the players are required to place an initial bet or ante wager for each play of the game. As indicated by block 104, the value of the game is determined. In one embodiment, the value of the game is determined based on the wagers placed by the players. In one embodiment, the wagers placed by the players are allocated to a pot. The player who wins the game wins the pot or a portion of the amount that has accumulated in the pot based on wagers placed during the course of the game.

As indicated by blocks 106 and 108, respectively, a round of betting occurs, and a first one of the players is provided with an opportunity to make a raise in the round of betting. In one embodiment, any of the players participating in the game can be the first player to use the opportunity to make a raise in the round of betting. As indicated by diamond 110, the controller determines if the first player makes the raise in the round of betting. If the first player does not make a raise in the round of betting, the controller determines, as indicated by diamond 112, whether another round of betting is possible. If another round of betting is not possible, the controller determines which player is the winner for the play of the game and provides the winner with an award based on the current value of the game, as indicated by blocks 114 and 116, respectively.

If the determination is made that the first player makes a raise in the round of betting, the second player can accept or reject the raise, as indicated by block 118. The controller determines whether the second player accepts the raise, as indicated by diamond 120. If the second player does not accept the first player's raise, game play terminates with respect to the second player, as indicated by block 122. In this example, only two players are competing in the game. Therefore, if the second player forfeits by not accepting the raise, the controller provides an award to the first player based on the current value of the game, as also indicated by block 122.

If the second player accepts the raise, the value of the game increases, as indicated by block 124. The controller then determines whether another round of betting is possible, as indicated by diamond 126. If another round of betting is not possible, the controller determines which player is the winner for the play of the game and provides the winner with an award based on the current value of the game, as indicated by blocks 114 and 116, respectively.

If another round of betting is possible, another round of betting commences and the second player (i.e., the player who accepted the previous raise) is provided with an opportunity to make a raise in that round of betting, as indicated by blocks 128 and 130, respectively. It should be appreciated that, in this embodiment, the first player cannot make a further raise in the game until the second player has used the provided opportunity to make a raise, as also indicated by block 130.

As indicated by diamond 132, the controller determines whether the second player makes a raise in the round of betting. If the determination is made that the second player does not make a raise in the round of betting, the controller determines whether another round of betting is possible, as indicated by block 126. If another round of betting is not possible, the controller determines which player is the winner for the play of the game, and provides the winner with an award based on the current value of the game, as indicated by blocks 114 and 116, respectively. If another round of betting is possible, a further round of betting occurs.

It should be appreciated that, if second player has the opportunity to make a raise in a betting round but does not use the opportunity in that betting round, the second player retains the right to propose a raise in the next betting round. In this embodiment, the first player will not have another opportunity to make a raise in the game until after the second player makes a raise.

If the controller determines that the second player makes a raise in the round of betting, the first player can accept or reject the second player's raise, as indicated by block 134. The controller determines whether the first player accepts the raise, as indicated by diamond 136. If the first player does not accept the raise, game play terminates with respect to the first player, and the second player wins the game, as indicated by block 138. Accordingly, the second player receives an award based on the current value of the game.

If the first player accepts the second player's raise, the value of the game increases, as indicated by block 140. It should be appreciated that, since the second player made a raise in the betting round, the first player now has the opportunity to make a next raise if a subsequent round of betting occurs. Accordingly, as indicated by block 112, the controller determines whether another round of betting is possible.

If another round of betting is not possible, the controller determines which player is the winner for the play of the game and provides the winner with an award based on the current value of the game, as indicated by blocks 114 and 116, respectively. If another round of betting is possible, the controller conducts another round of betting, wherein the first player is provided the opportunity to make a raise, as indicated by blocks 106 and 108. The game continues in this manner until no more betting is possible, at which point a winner is identified and provided with an award based on the current value of the game. It should be appreciated that in between, or prior to, each round of betting, game play is occurring. For example, in a poker game, players are dealt a new card between round of betting.

Accordingly, if the players choose high risk mode, in one embodiment, a wagering control feature is provided wherein the opportunity to propose a raise alternates from one player to another. In such an embodiment, the player in control of the wagering control feature is the only player who can make a raise in the game. It should be appreciated that this high risk mode wagering control feature can be applied in any multi-player, multi-stakes wagering game to prevent one player from repeatedly raising and forcing another player out of the game.

In one embodiment, the player in control of the wagering feature is the only player who can initiate a wager in a round of betting. In one embodiment, the wagering control feature of the present disclosure enables players to make heightened wagers or raises. For example, the typical raise amount for a betting round of a game is $2, but by invoking the wagering control feature, a player can raise $5 in the betting round.

Referring back to diamond 94 of FIG. 3A, if the determination is made that the matched players did not select high risk mode (i.e., the players selected low risk mode and were matched based on their compatible selections of high risk mode), sub-sequence B is executed, as indicated by block 98.

Figure 3C:
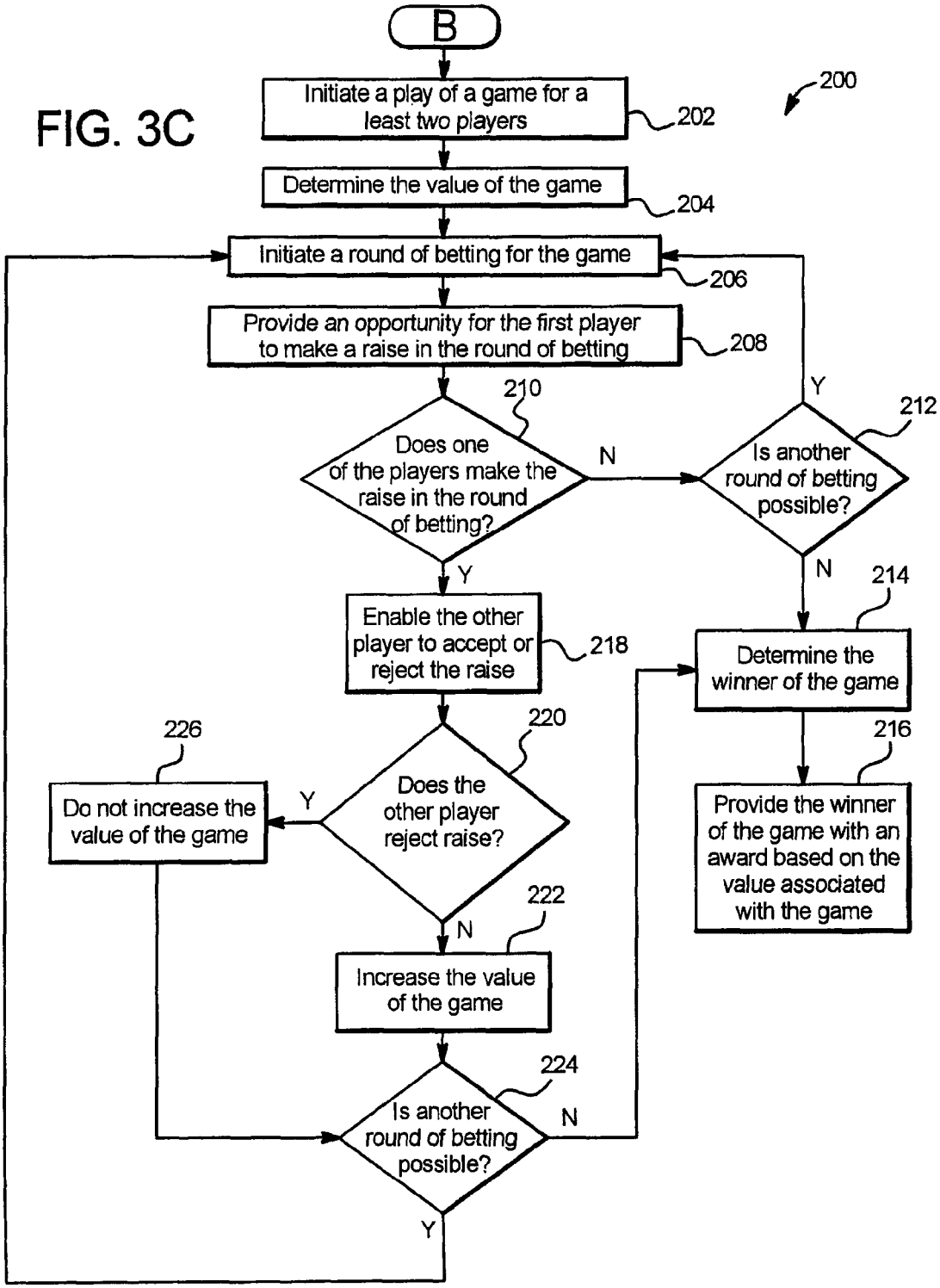

Referring now to FIG. 3C, a play of the wagering game employing low risk mode operates according to sub-sequence B 200. A play of wagering game initiates and the value of the game is determined, as indicated by blocks 202 and 204, respectively. After the game begins, a first round of betting occurs, as indicated by block 206. The controller provides an opportunity for one of the players to make a raise in the round of betting, as indicated by block 208.

The controller determines whether any of the players have made a raise in the round of betting, as indicated by diamond 210. If none of the players have used the opportunity to make a raise in the game, the controller determines whether another round of betting will occur, as indicated by block 212. If another round of betting is not possible, the controller determines which player is the winner for the play of the game, and provides the winner with an award based on the current value of the game, as indicated by blocks 214 and 216, respectively.

If it is determined, at diamond 210, that one of the players makes a raise in the round of betting, the other player can accept or reject the proposed raise, as indicated by block 218. The controller determines whether the other player rejects the raise, as indicated by diamond 220.

If the other player does not reject the raise (i.e., elects to match the opponent's raise), the value of the game increases, as indicated by block 222. The controller then determines whether another round of betting will occur, as indicated by block 224. If another round of betting is not possible, the controller determines which player is the winner for the play of the game and provides the winner with an award based on the current value of the game, as indicated by blocks 214 and 216, respectively. If it is determined that another round of betting will occur, the gaming device initiates another round of betting, as indicated by block 206.

If it is determined that the other player rejects the proposed raise, the controller does not increase the value of the game, as indicated by block 226. The controller then determines whether another round of betting will occur, as indicated by block 224. If another round of betting is not possible, the controller determines which player is the winner for the play of the game and provides the winner with an award based on the current value of the game, as indicated by blocks 214 and 216, respectively. If it is determined that another round of betting is possible, the gaming device initiates another round of betting, as indicated by block 206.

As illustrated by sub-sequence B 200, the low risk mode wagering control feature of this embodiment, enables players to decline raise actions proposed by their opponents and continue playing the game without penalty. Thus, players who choose the low risk mode have the option to continue playing a game when they otherwise may have forfeited or folded.

In various alternative embodiments, the number of times that players may decline raises proposed by their opponents is different. In one such embodiment, each of the players has an unlimited number of opportunities to decline raises proposed by an opponent during a play of the game. In another embodiment, each player may decline a raise action once per play of a game. In another embodiment, each player may decline a raise action a designated number of times per play of a game. In other embodiments, the opportunity to decline a raise action alternates from one player to another. For example, if a first player proposes a raise, and a second player declines that raise, only the first player can decline the next raise that is proposed in the game. In such embodiments, the second player cannot decline a subsequently proposed raise until the first player has used the opportunity to decline a raise. It should be appreciated that the number of times a player may invoke the wagering control mechanism to decline a raise may be predetermined, randomly determined, based on the player's wagering activity, based on player tracking, or determined in any other suitable method.

Referring now generally to FIGS. 4A to 4C, 5A to 5C, 6A to 6C, 7A to 7C, 8A, and 8B, one example embodiment of the present disclosure includes a variation of a Texas Hold 'Em poker game. In this example, two players 66*a*, 66*b* compete against one another in a play of the poker game. In different embodiments, the number of players may be greater than two. In this example, the players 66*a* and 66*b* have chosen the high risk mode and are matched up for game play based at least in part on their selections of the high risk mode. Thus, the players 66*a* and 66*b* will compete against one another in a play of the poker game employing the high risk mode wagering control feature.

Figure 4B:
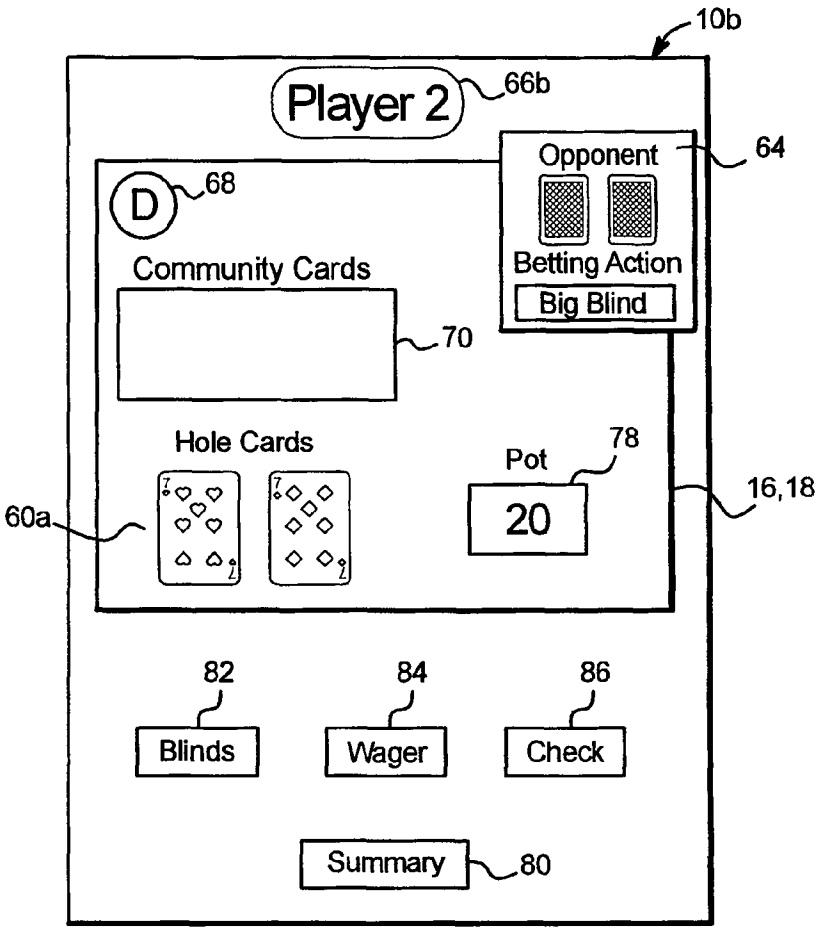
Figure 4A:
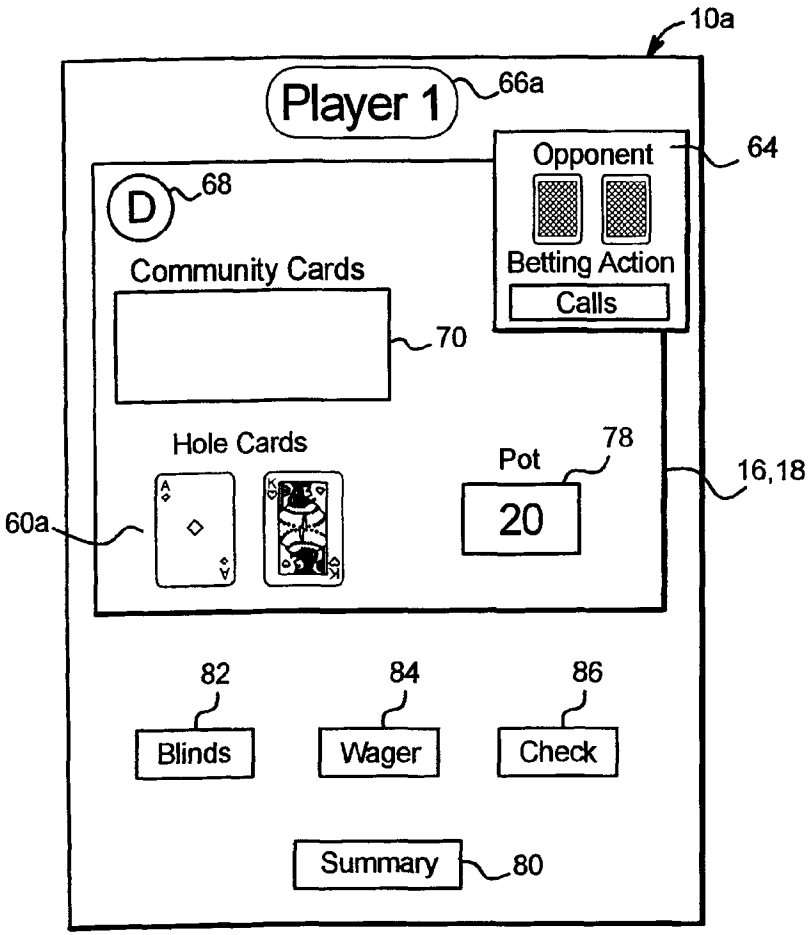

As seen in FIGS. 4A and 4B, each player's gaming device includes a display device 16 or 18 to display the poker game. For ease of illustration, each of the relevant apparatus is shown on the same display device 16 or 18. In alternative embodiments, different areas of the gaming device 10 display the relevant portions of the game.

FIG. 4A illustrates the screen that Player one 66*a* sees at his or her respective gaming device 10*a*. As seen in FIG. 4A, the gaming device 10*a* displays a community card area 70 and Player one's hole cards 60*a*. A pot display 78 indicates to Player one 66*a* how much is currently at stake in the game. The gaming device 10*a* includes a display window 64 which shows Player one 66*a* the opponent's (i.e., Player two's) face-down cards and the opponent's betting action in the game. That is, the display window 64 shows Player one 66*a* whether Player two 66*b* chooses to check, raise, or call during each round of betting in the game.

FIG. 4B illustrates the screen that Player two 66*b* sees at his or her respective gaming device 10*b*. As seen in FIG. 4B, the gaming device 10*b* displays a community card area 70 and Player two's hole cards 60*b*. A pot display 78 indicates to Player two 66*b* how much is currently at stake in the game. The gaming device 10*b* also includes a display window 64 which shows Player two 66*b* the opponent's (i.e., Player one's) face-down cards and the opponent's betting action in the game.

In this example, each player's screen includes a blinds input 82, a wager input 84, and a check input 86. In other embodiments, different inputs and display areas may be provided. As seen in FIGS. 4A and 4B, each player's screen also includes a summary input 80. At any point during game play, the players can activate the summary input 80 to view a summary 300 of the play of the game. In certain embodiments, the summary 300 keeps track of the wagers placed by each player in each betting round, the amount in the pot, the player who is in control of raising, and any other information relating to game play.

In one embodiment, the controller assigns one of the players 66*a*, 66*b* to be the dealer for the play of the game. In one such embodiment, a dealer indicator 68 appears on the display screen to indicate which player is the dealer for the play of the game. As illustrated in FIG. 4A, the dealer indicator 68 appears on Player one's screen. It should be appreciated that the position of dealer alternates between players from one hand to another during the game.

After Player one 66*a* is designated as the dealer for the play of the game, the players 66*a*, 66*b* place initial bets called the big blind and the small blind. In one embodiment, the player designated as the dealer places the big blind, and the other player places the small blind. In this example, Player one 66*a* places the big blind of 10 credits, and Player two 66*b* places the small blind of 5 credits. Once the players 66*a*, 66*b* have placed the blinds, an initial hand of cards is dealt to each player. The game follows the rules of Texas Hold 'Em with each player receiving two initial hole cards 60*a*, 60*b*. The hole cards 60*a*, 60*b* are dealt from a virtual deck of fifty-two playing cards. Player one's hole cards 60*a* are A♦K♥, and Player two's hole cards 60*b* are 7♥7♦, as illustrated in FIGS. 4A and 4B.

After the players 66*a*, 66*b* receive their hole cards 60*a*, 60*b*, a first round of betting occurs based on the players' current hands. Player one 66*a* (i.e., the dealer) placed the big blind wager of 10 credits, and this plays as a bet. Accordingly, as seen in FIG. 4B, Player two's display window 64 indicates that Player one 66*a* has placed the big blinds. Player two 66*b* acts first in the first round of betting. Player two 66*b* must call, raise, or fold. If Player two 66*b* decides to fold, game play terminates with respect to Player two 66*b*, and the amount in the pot 78 is awarded to Player one 66*a*. To call, Player two 66*b* must bet the amount of the small blind. The big blind is twice that of the small blind, and therefore, the minimum bet amount that Player two 66*b* can make is equal to the small blind amount (i.e., 5 credits).

As seen in FIG. 4A, Player one's display window 64 indicates that Player two 66*b* calls by placing a bet of 5 credits. Player one 66*a* checks, which ends the first betting round. The amount in the pot is 20 credits, as indicated by the pot display 78. At this point in the game, neither of the players have made a raise. Accordingly, either Player one 66*a* or Player two 66*b* may propose a raise in the game. FIG. 4C illustrates the summary 300, which provides information about the first betting round.

Figure 5B:
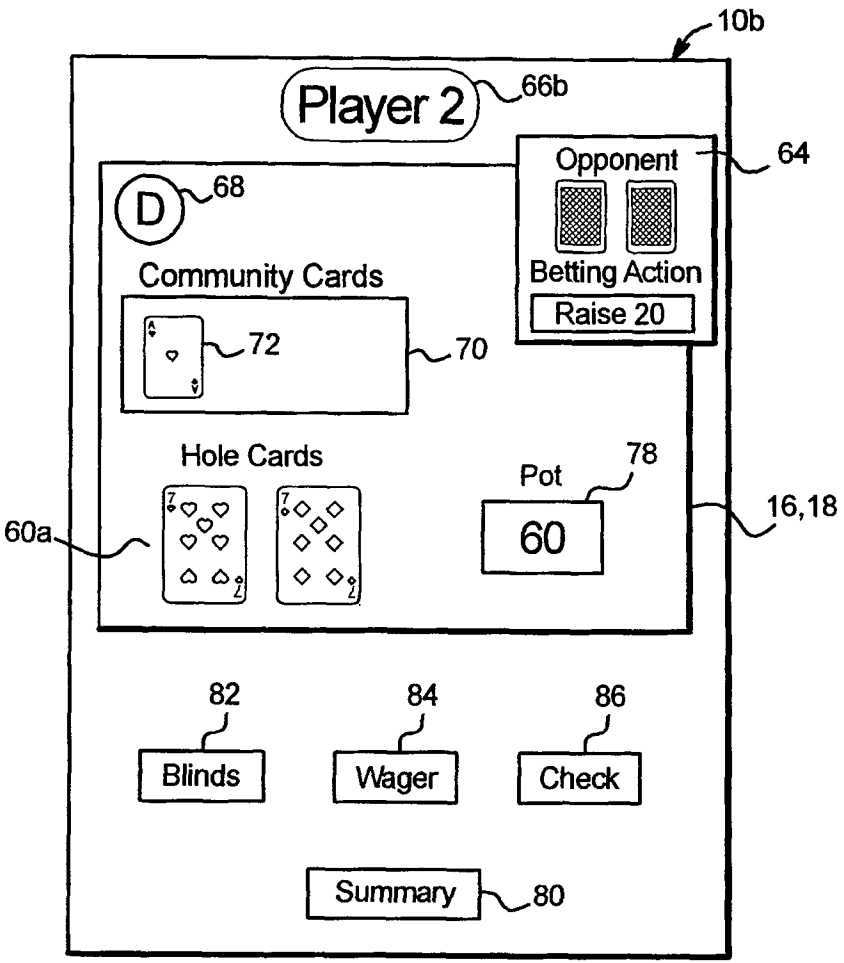
Figure 5A:
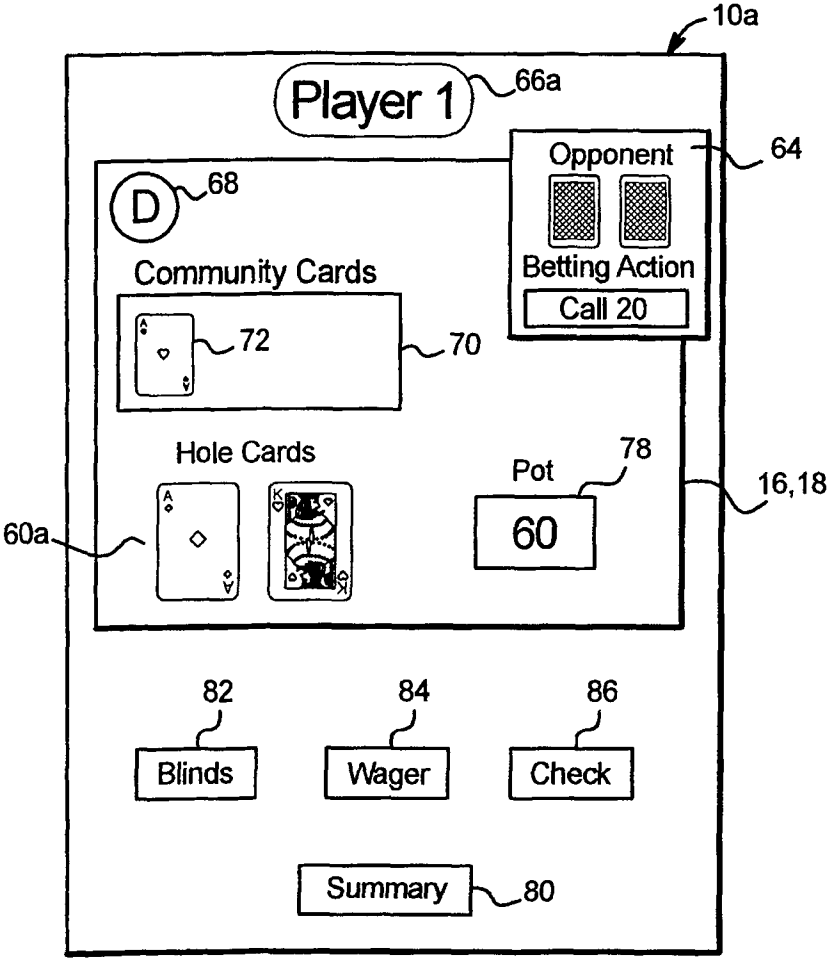

As seen in FIGS. 5A and 5B, once the first betting round ends, the flop card 72 is dealt and displayed in the community card area 70. The flop card 72 is the A♥ and is a community card that is used in each of the two player hands. It should be appreciated that in other embodiments, the flop deal may include three cards instead of one card, as in traditional Texas Hold'em games. At this point, the players 66*a*, 66*b* each have a three-card hand consisting of their respective hole cards and the first community card or flop card 72. Player one's hand includes A♥A♦K♥, which includes a single pair of Aces. Player two's hand includes a pair of 7–(7♦ with an A♥ as the high card.

After the flop 72 is dealt, a second round of betting occurs. Player one 66*a* remains the designated dealer in this play of the game, so Player two 66*b* acts first in the second round of betting. In this round of betting, Player two 66*b* checks, and Player one 66*a* proposes a raise of 20 credits. Player two 66*b* must accept or reject Player one's raise. Player two 66*b* accepts the raise and the betting round ends. In this embodiment, once a player accepts or rejects a raise proposed by his or her opponent, the betting round ends. That is, only one raise is permitted per round. The amount in the pot 78 increases by 40 credits (i.e., there is a total of 60 credits in the pot 78), and Player two 66*b* is now in control of raising in the game. That is, Player two 66*b* has the exclusive right to make a next raise in the game, and Player one 66*a* cannot propose a further raise until after Player two 66*b* has made a raise. FIG. 5C illustrates the summary 300, which includes information about the first and second betting rounds in the play of the game.

Figure 6B:
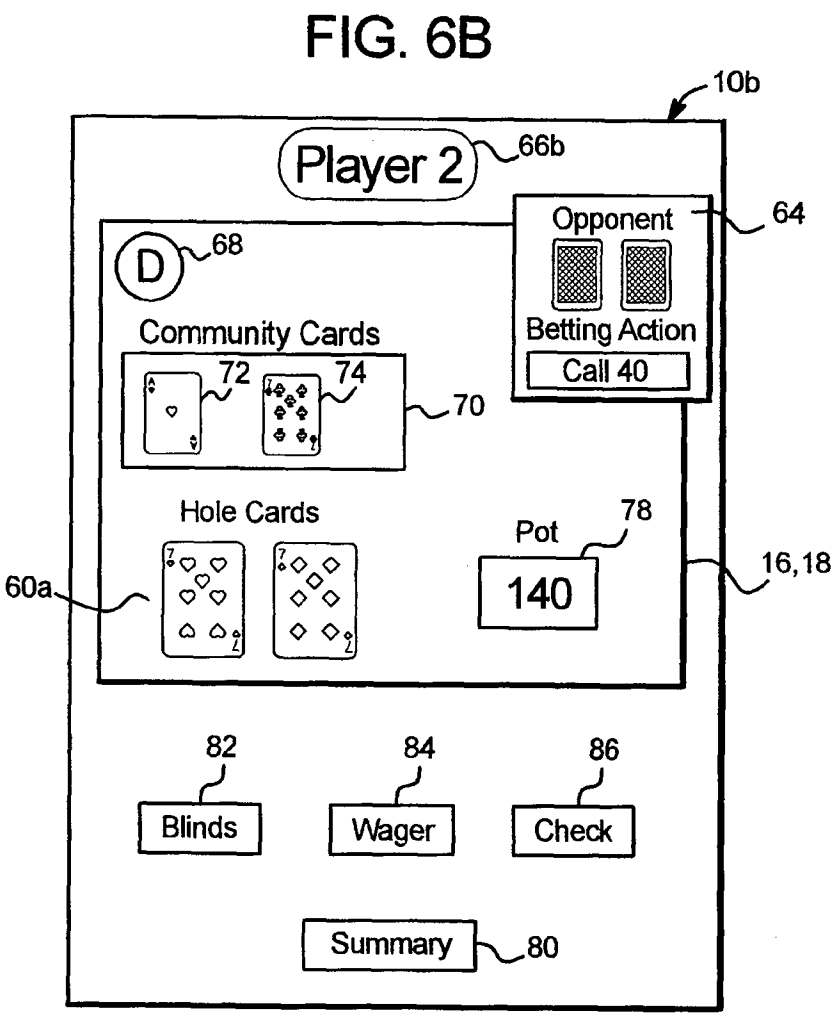
Figure 6A:
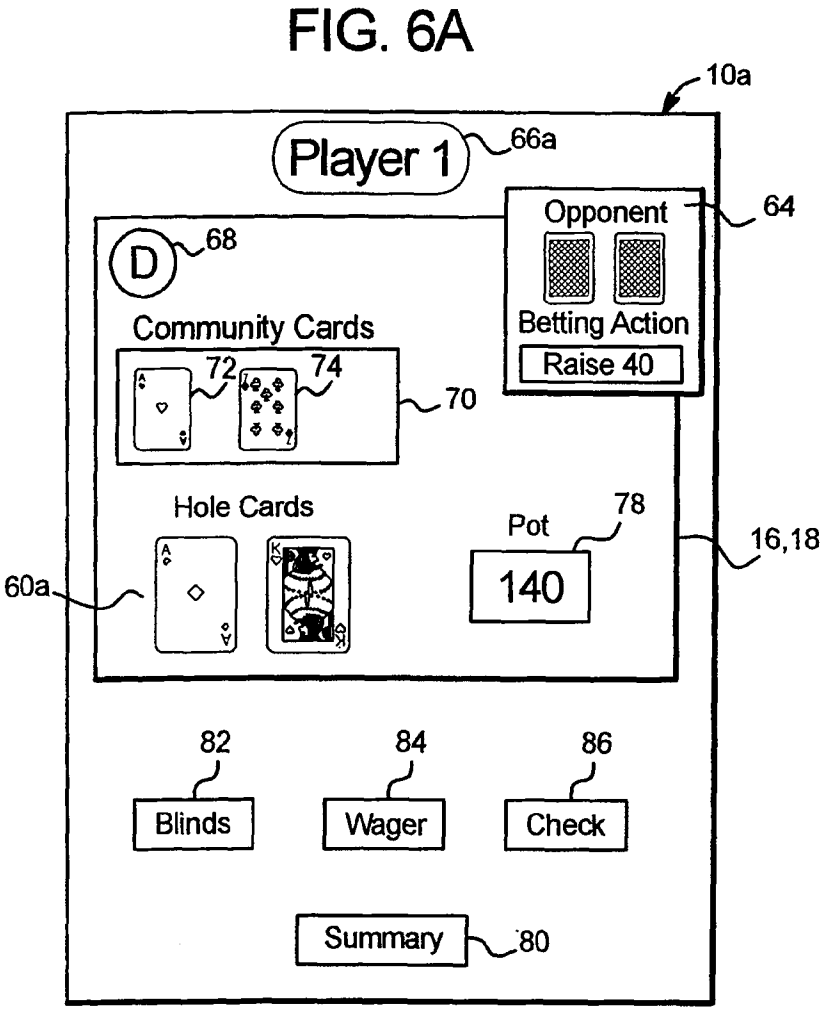

As shown in FIGS. 6A and 6B, after the second betting round, the turn card 74 is dealt and displayed in the community card area 70. The turn card 74 is the 7♣ and is also a community card that is used in each of the players' hands. At this point, the players 66*a*, 66*b* each have a four-card hand consisting of their respective initially dealt hole cards, the first community card or flop card 72, and the second community card or turn card 74. Player one's hand includes A♥A♦K♥7♣, which includes a single pair of Aces. Player two's hand includes 7♥7♦7♠A♥, which includes a Three-Of-A-Kind of sevens.

After dealing the turn card 74, the third round of betting occurs starting with Player two 66*b*. Player two 66*b* is in control of raising. Player two 66*b* has a strong hand which includes a Three-Of-A-Kind of sevens. Therefore, Player two 66*b* proposes a raise of 40 credits in the third betting round, as indicated in Player one's display window 64. Player one 66*a* can either: (1) accept the raise and continue playing, or (2) reject the raise and forfeit the game. Player one 66*a* accepts the raise, as indicated in Player two's display window 64. The amount in the pot 78 increases by 80 credits (i.e., the pot 78 includes a total of 140 credits). Player one 66*a* is now in control of raising. FIG. 6C illustrates the summary 300, which includes information about the first, second, and third betting rounds that have occurred.

Figure 7B:
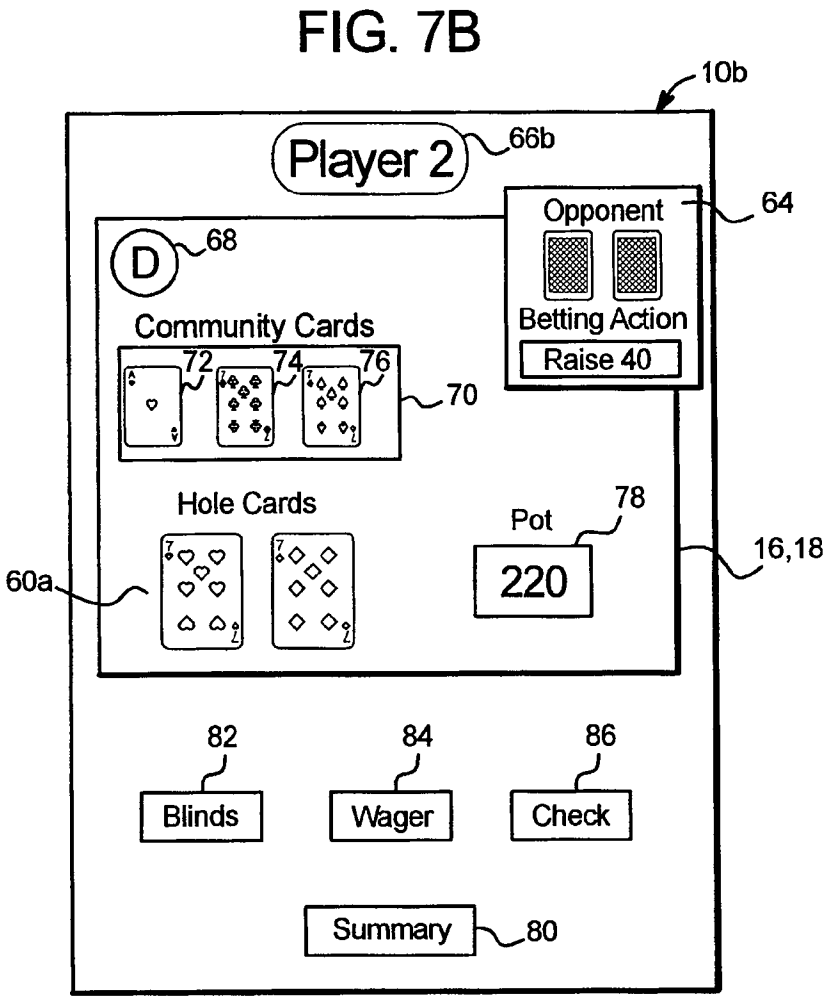
Figure 7A:
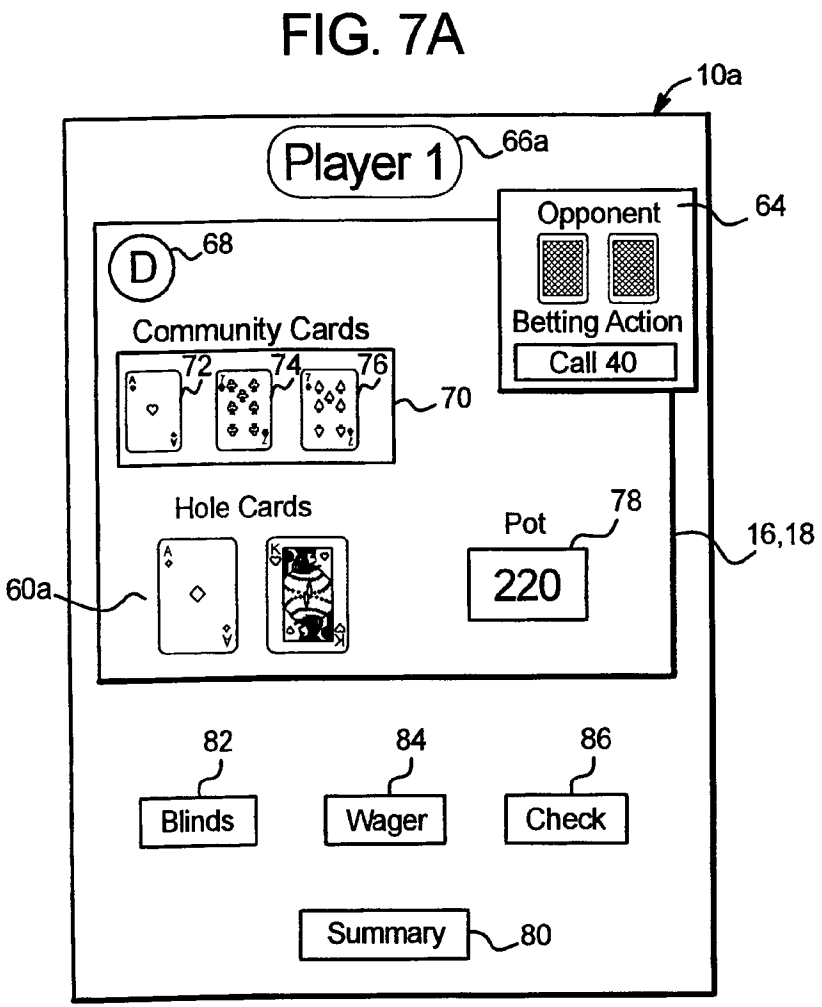

As shown in FIGS. 7A and 7B, after the third betting round, the river card 76 is dealt and displayed in the community card area 70. The river card 76 is the 7♠ and is also a community card that is used in each of the two player hands. At this point, the players 66*a*, 66*b* each have a complete five-card hand consisting of their respective initially-dealt two hole cards, the first community card or flop card 72, the second community card or turn card 74, and the third community card or river card 76. Player one's hand includes A♥A♦K♥7♣7♠, which includes a pair of Aces and a pair of sevens. Player two's hand includes 7♥7♦7♣7♠A♥, which includes a Four-Of-A-Kind of sevens.

A fourth betting round occurs after the river card 76 is dealt. In the fourth betting round, Player one 66*a* is in control of raising. Therefore, Player two 66*a* cannot propose a raise even though Player two 66*a* has a strong hand. Player two 66*a* checks, and Player one 66*a* proposes a raise of 40 credits. Player two 66*b* accepts the raise, and the pot 78 now has a total of 220 credits. FIG. 7C illustrates the summary 300, which includes information about the first, second, third, and fourth betting rounds in this play of the poker game.

Figure 8B:
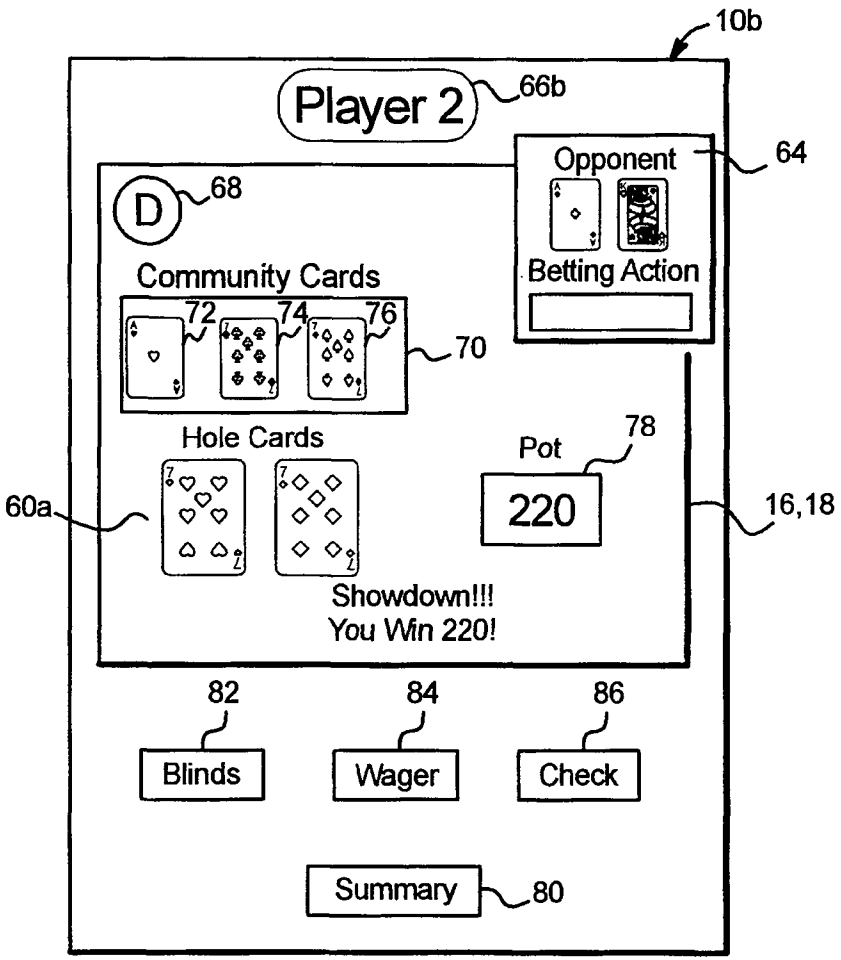
FIGS. 8A and 8B illustrate a showdown in a play of a Texas Hold 'Em poker game employing a high risk mode wagering control feature.
Figure 8A:
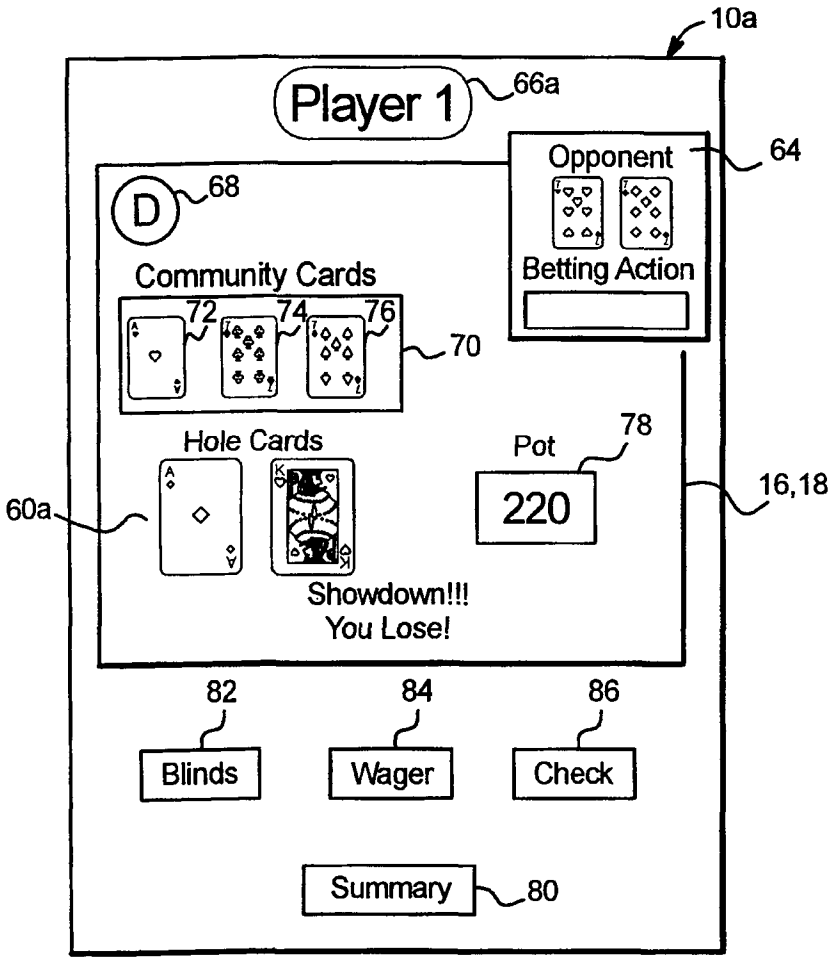

FIGS. 8A and 8B depict a showdown between the two players. During the showdown, the players' hole cards are revealed and the players' hands are compared. As seen in FIGS. 8A and 8B, Player two's hand outranks Player one's hand because a four-of-a-kind outranks any two pairs according to the rules of poker. Thus, Player two 66*b* wins the 220 credits that have accumulated in the pot 78. Player one 66*a* forfeits the big blind and each of the three additional wagers that Player one 66*a* placed during the play of the game. For the next hand, Player two 66*b* will be the designated dealer and play begins accordingly.

Referring now generally to FIGS. 9A to 9C, 10A to 10C, 11A to 11C, 12A to 12C, 13A, and 13B, another example of a Texas Hold 'Em poker game is illustrated. In this example, the players selected low risk mode of play and are matched up for competitive game play based at least in part on their compatible selections of low risk mode.

Figure 9B:
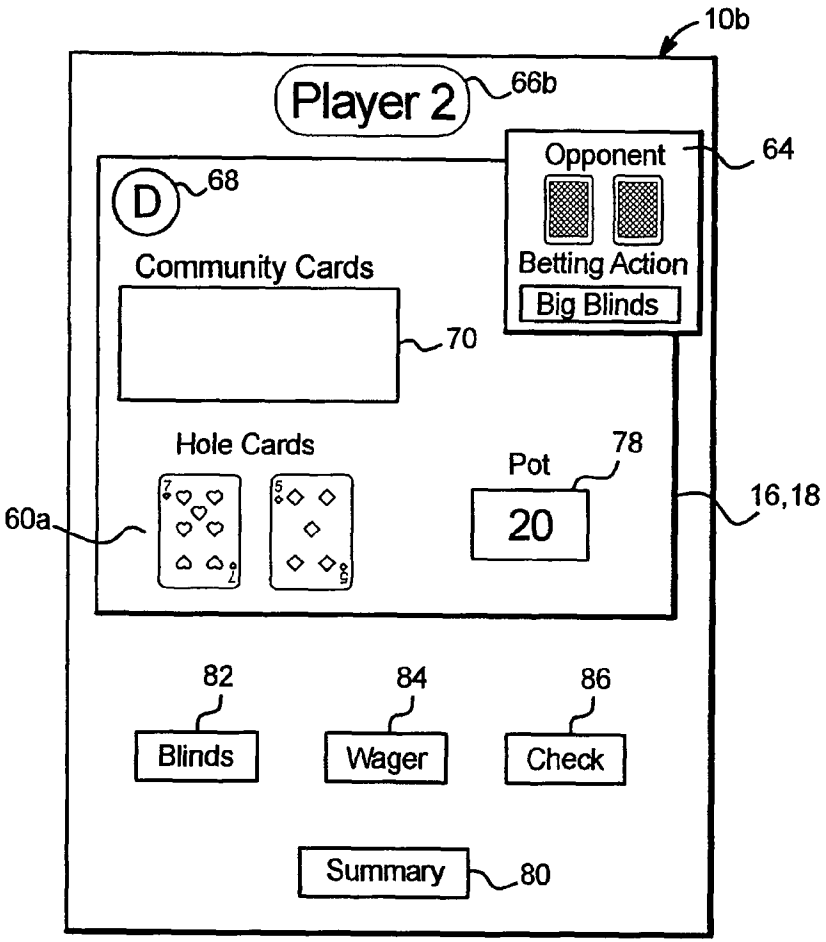
Figure 9A:
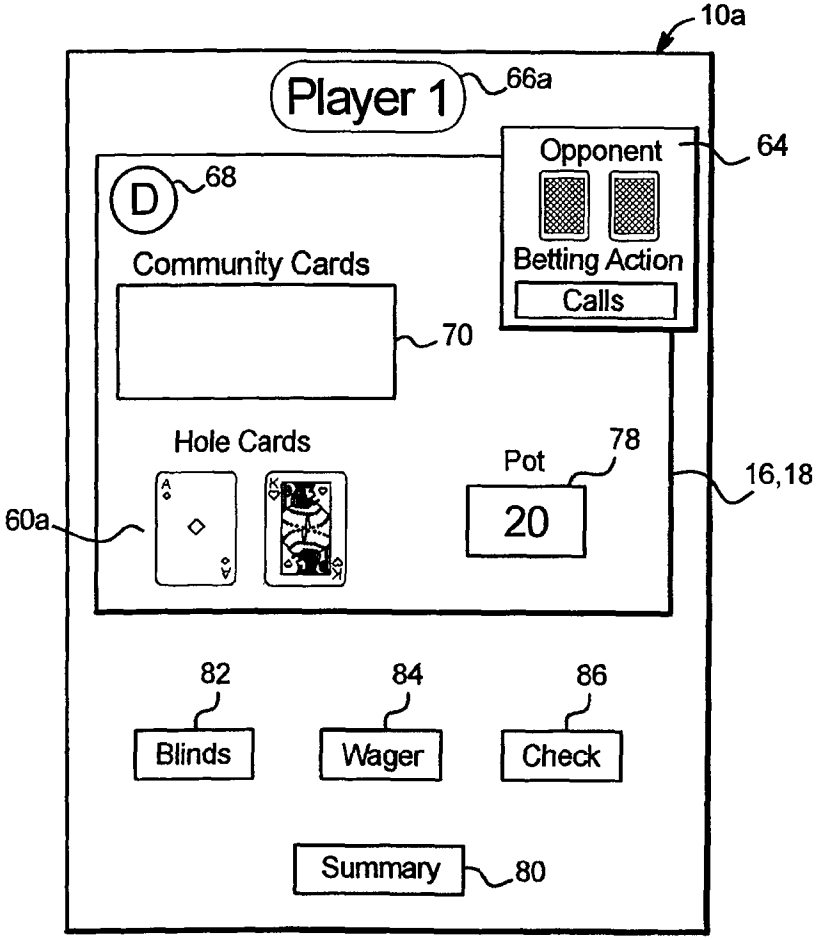

As illustrated in FIGS. 9A and 9B, Player 1 66*a* is the dealer for the play of the game. Accordingly, the dealer indicator 68 appears on Player one's screen. After the determination is made that Player one 66*a* will be the dealer, Player one 66*a* and Player two 66*b* place the big blind and the small blind, respectively. Once the players 66*a*, 66*b* have placed the blinds, an initial hand of cards is dealt to each player. Each of the players 66*a*, 66*b* receives two initial hole cards 60*a*, 60*b*. As seen in FIGS. 9A and 9B, Player one's hole cards 60*a* are A♦K♥, and Player two's hole cards 60*b* are 7♥5♦.

After the players 66*a*, 66*b* receive their hole cards 60*a*, 60*b*, a first round of betting occurs based on the players' current hands. Player one 66*a* (i.e., the dealer) placed the big blind wager of 10 credits, and this plays as a bet. Player two 66*b* is, therefore, prompted to act first in the first round of betting. In other words, Player two 66*b* must call, raise, or fold. If Player two 66*b* folds, game play terminates with respect to Player two 66*b*, and the pot is awarded to Player one 66*a*. If Player two 66*b* calls, Player one 66*a* can: (1) check, which would end the betting round, or (2) raise the call which causes the betting round to continue. To call, Player two 66*b* must bet the amount of the small blind (i.e., 5 credits).

As indicated by Player one's display window 64, Player two 66*s* calls by placing a bet of 5 credits. Player one 66*a* checks which ends the first betting round. The pot 78 includes 20 credits, as indicated by the pot display 78. FIG. 9C illustrates the summary 300, which includes information about the first betting round in this play of the poker game.

Figure 10B:
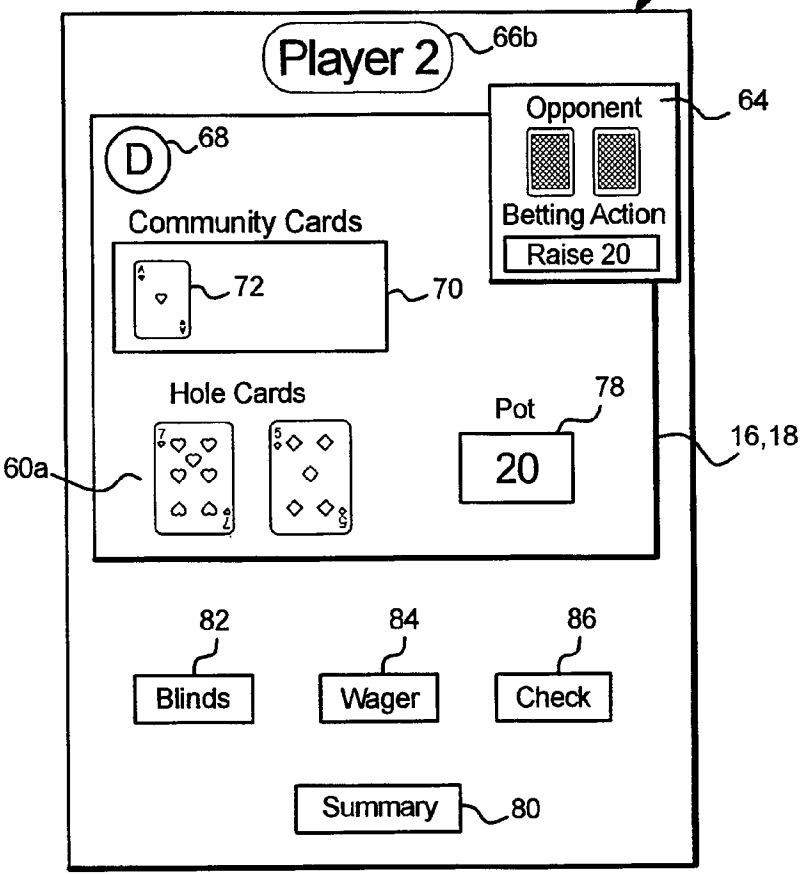
Figure 10A:
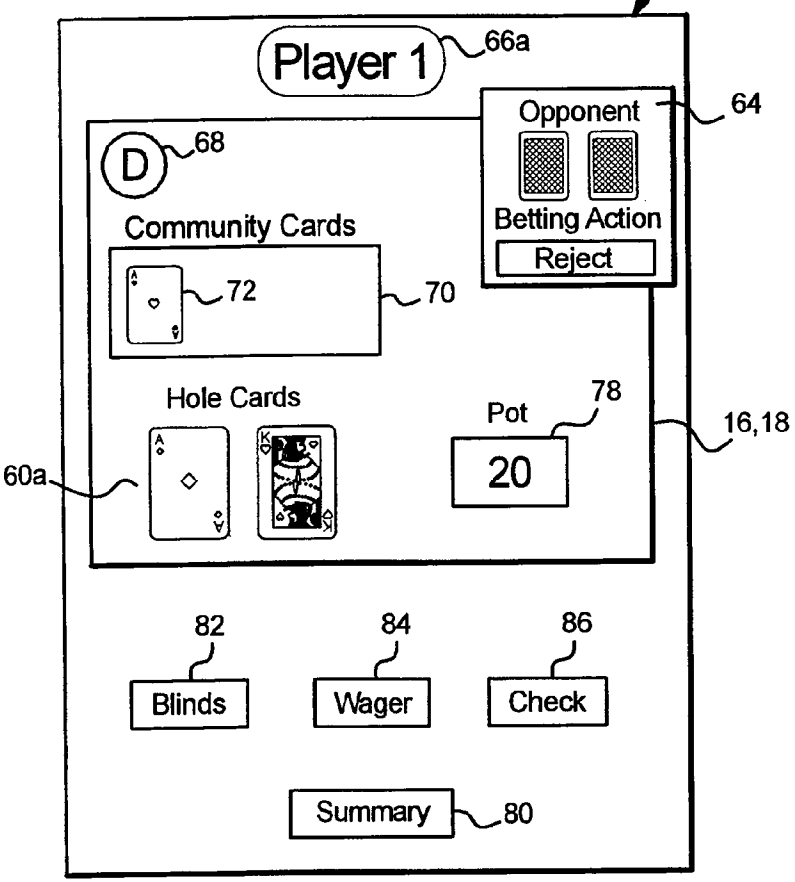

As seen in FIGS. 10A and 10B, once the first betting round ends, the flop card 72 is dealt and displayed in the community card area 70. The flop card 72 is the A♥ and is a community card that is used in each of the two player hands. At this point, the players 66*a* and 66*b* each have a three-card hand consisting of their respective hole cards and the first community card or flop card 72. Player one's hand includes A♥A♦K♥, which includes a single pair of Aces. Player two's hand includes 7♥5♦A–(.

After the flop card 72 is dealt, a second round of betting occurs. Player two 66*b* acts first in the second round of betting. Player two 66*b* checks based on the three-card hand which includes the community flop card 72. Player one 66*a* proposes a raise of 20 credits. Player two 66*b* can either accept or reject the raise proposed by Player one 66*a*. Player two 66*b* rejects the raise, which ends the second betting round. The amount in the pot 78 is still 20 credits. FIG. 10C illustrates the summary 300, which includes information about the first and second betting rounds.

It should be appreciated that, in this example, although Player two 66*b* did not match the raise proposed by Player one 66*a*, Player two 66*b* will continue to play the game without penalty. In one embodiment, once a player accepts or rejects a raise proposed by his or her opponent, the betting round ends. That is, only one raise is permitted per round. In other embodiments, the number of raises permitted in a round of betting may be greater than one.

Figure 11B:
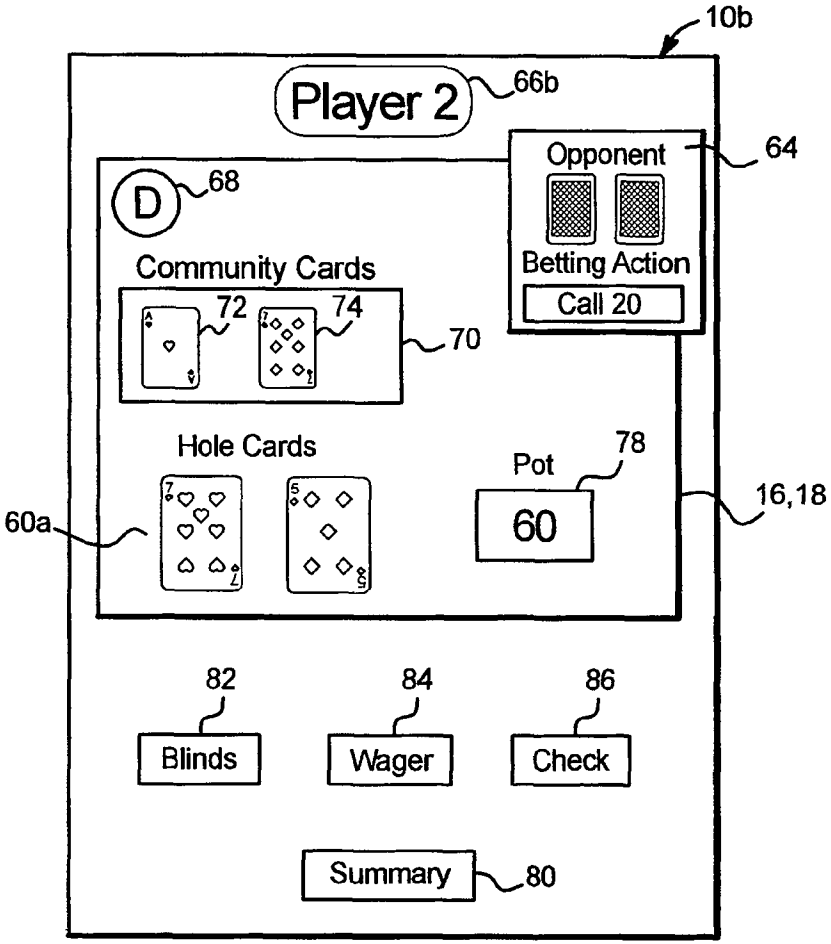
Figure 11A:
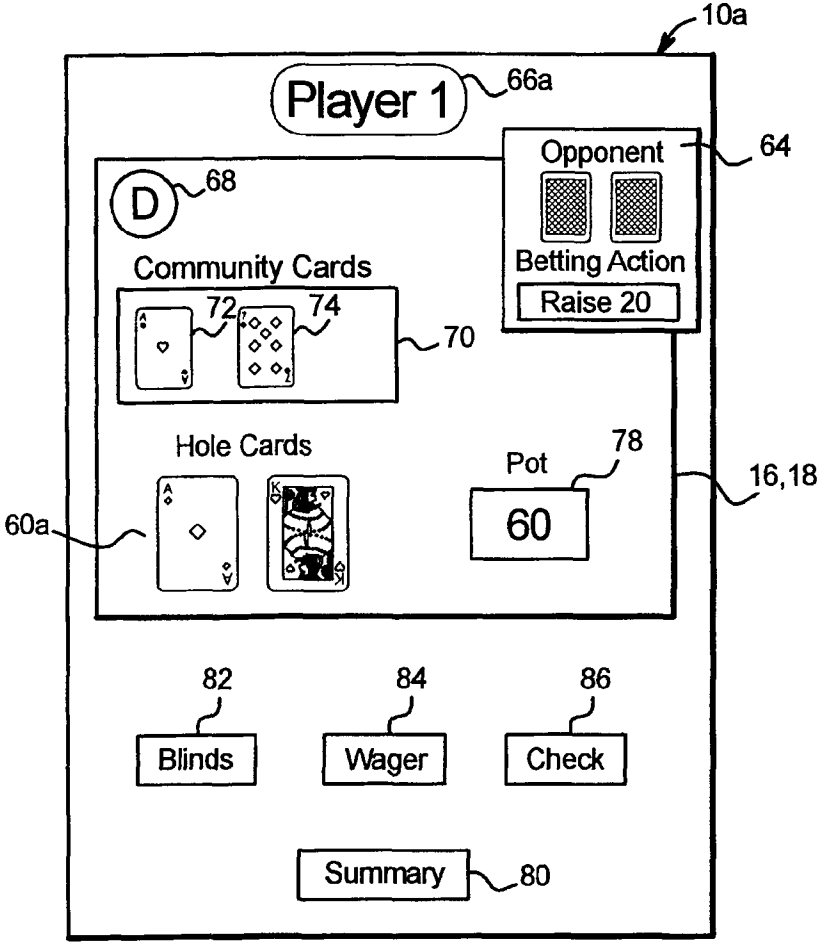

As seen in FIGS. 11A and 11B, upon completion of the second betting round, the turn card 74 is dealt and displayed in the community card area 70. The turn card 74 is the 7♦ and is a community card that is used in each of the two player hands. At this point, the players 66*a*, 66*b* each have a four-card hand consisting of their respective hole cards, the first community card or flop card 72, and the second community card or turn card 74. Player one's hand includes A♥A♦K♥7♦, which includes a single pair of Aces. Player two's hand includes 7♥7♦5♦A♥, which includes a single pair of sevens.

After the turn card 74 is dealt, a third round of betting occurs. Player two 66*b* acts first in the third round of betting. As indicated by the Player one's display window 64, Player two 66*b* proposes a raise of 20 credits based on the four-card hand which includes the pair of sevens. Player one 66*a* can either accept or reject the raise proposed by Player two 66*b*. As seen in Player two's display window 64, Player one 66*a* accepts the raise, which ends the third betting round. The amount in the pot 78 increases to 60 credits. FIG. 11C illustrates the summary 300, which includes information about the first, second, and third betting rounds in this play of the poker game.

Figure 12B:
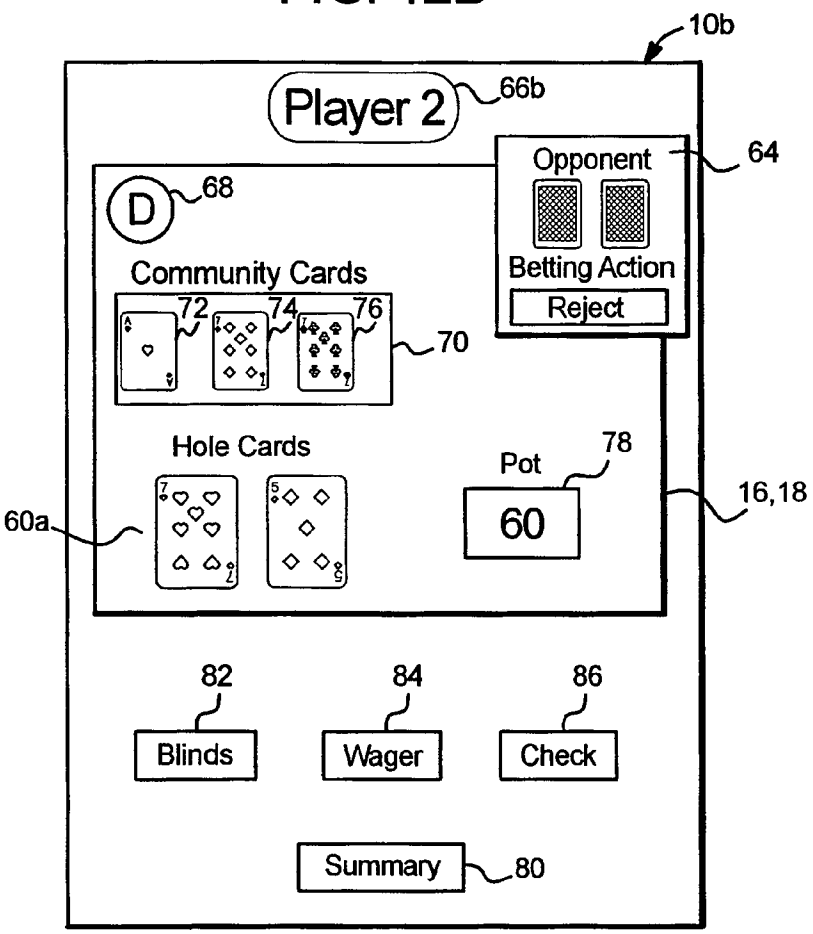
Figure 12A:
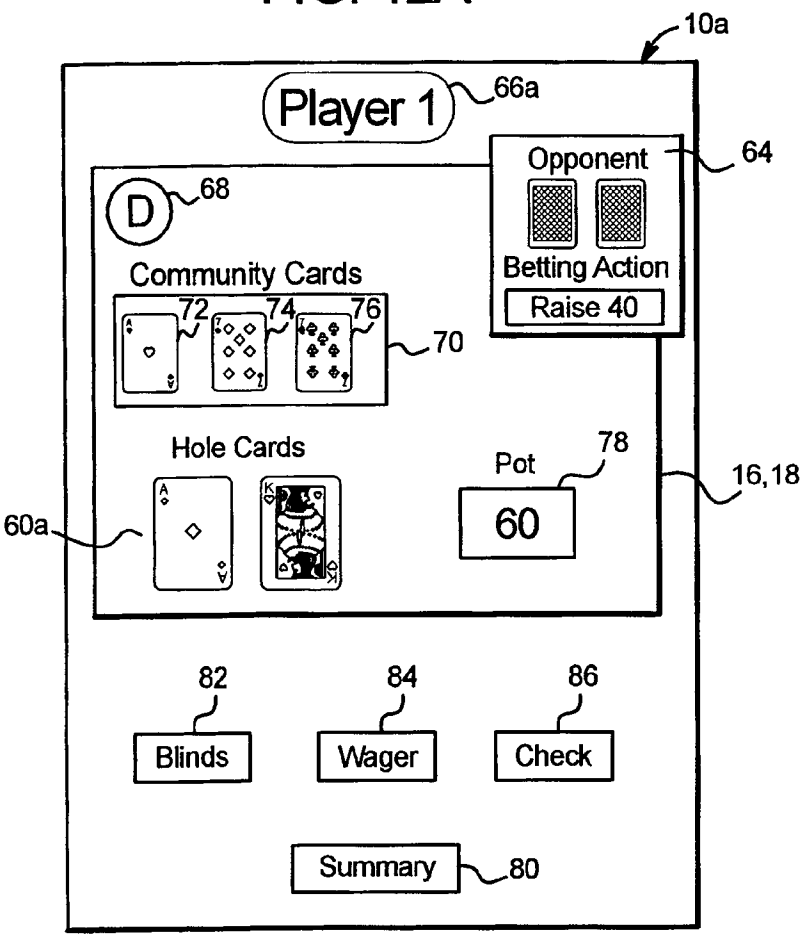

As seen in FIGS. 12A and 12B, after the third betting round, the river card 76 is dealt and displayed in the community card area 70. The river card 76 is the 7♣ and is a community card that is used in each of the two player hands. At this point, the players 66*a*, 66*b* each have a complete five-card hand consisting of their respective hole cards, the first community card or flop card 72, the second community card or turn card 74, and the third community card or river card 76. Player one's hand includes A♥A♦K♥7♦7♣ , which includes a pair of Aces and a pair of sevens. Player two's hand includes 7♥7♦7♣ 5♦A♥, which includes a Three-of-a-kind sevens.

After the river card 76 is dealt, a fourth and final round of betting occurs. Player two 66*b* acts first in the third round of betting. As indicated by Player one's display window 64, Player two 66*b* proposes a raise of 40 credits based on the four-card hand which includes the Three-of-a-kind sevens. Player one 66*a* can either accept or reject the raise proposed by Player two 66*s*. As seen in Player two's display window 64, Player one 66*a* rejects the raise. The fourth betting round ends, and the amount in the pot 78 does not change (i.e., the pot includes 60 credits). FIG. 12C illustrates the summary 300, which includes information about each of the four betting rounds that have occurred.

Figure 13B:
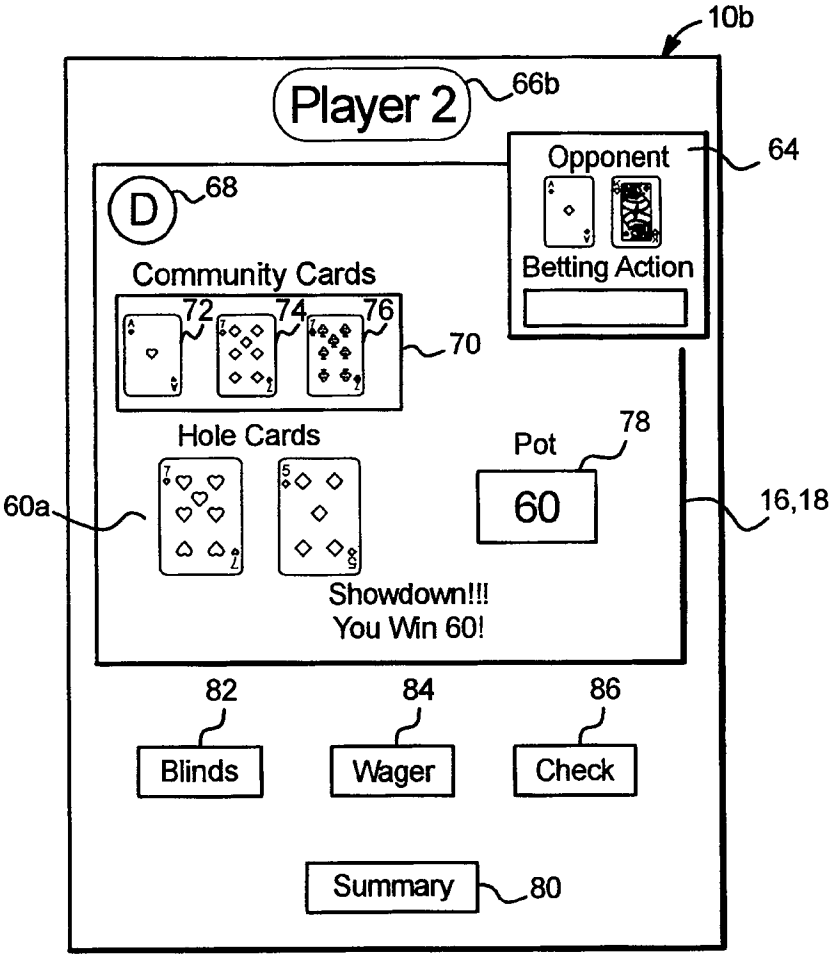
FIGS. 13A and 13B illustrate a showdown in a play of a Texas Hold 'Em poker game employing a low risk mode wagering control feature.
Figure 13A:
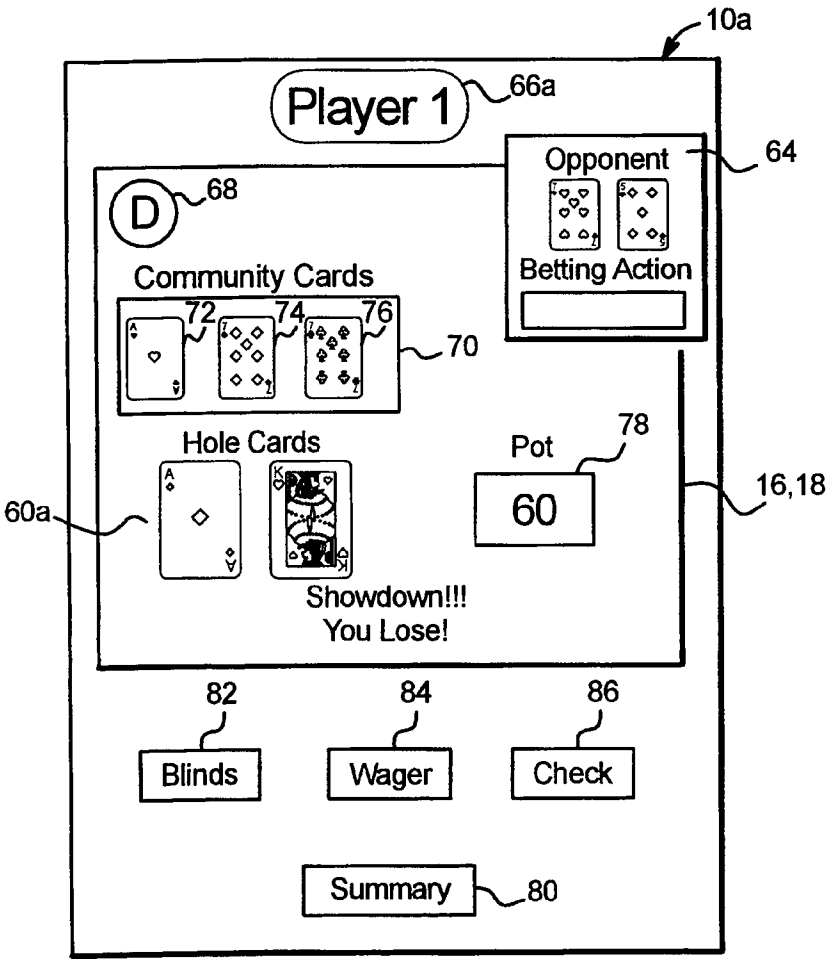

As illustrated in FIGS. 13A and 13B, after the fourth betting round, a showdown occurs. The players' hole cards 60*a*, 60*b* are revealed and the players' hands are compared to see which player wins the amount that has accumulated in the pot 78. It should be appreciated that, although Player one 66*a* rejected the raise proposed by Player two 66*b* in the fourth round of betting, Player one 66*a* is still eligible to win the amount in the pot 78. As seen in FIGS. 13A and 13B, Player two's hand outranks Player one's hand (i.e., three-of-a-kind outranks two pairs), and Player two 66*b* wins the 60 credits which have accumulated in the pot 78. Thus, Player one 66*a* forfeits the big blind and additional wager that Player one 66*a* placed during the third round of betting. However, by rejecting Player two's proposed raise in the fourth round of betting, Player one 66*a* did not have to wager any more credits to stay in the game and, therefore, was able to mitigate the loss.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A method of operating a gaming system including a plurality of gaming devices configured to communicate with a controller, said method comprising:

(a) initiating a play of a wagering game for a plurality of players including at least two players, wherein said play of the wagering game is associated with a value;

(b) providing a plurality of opportunities at which designated bets can be made in said play of the wagering game, wherein each of said opportunities includes:

(i) enabling a first one of the players to make one of said designated bets, (ii) if said first one of the players makes one of said designated bets, enabling a second one of the players to accept or reject the designated bet made by the first one of the players, (iii) if the second one of the players accepts the designated bet made by the first one of the players, increasing the value associated with the play of the wagering game and enabling each of the players to continue participating in said play of the wagering game, and (iv) if the second one of the players rejects the designated bet made by the first one of the players, not increasing the value associated the play of the wagering game and enabling each of the players to continue participating in said play of the wagering game; and (c) after a final one of said opportunities, determining which of the players participating in the play of the wagering game is a winning player and providing an award to the winning player based on the value associated with the play of the wagering game after said final one of the opportunities.

2. The method of claim 1, wherein, if the first one of the players makes one of said designated bets at a first one of said opportunities and the second one of the players rejects the designated bet made by the first one of the players, said second one of the players is not enabled to reject another designated bet made in said play of the game until the first one of the players rejects a designated bet made at a subsequent one of the opportunities.

3. The method of claim 1, which includes providing an indication to inform said players which player is enabled to reject the designated bet at each of said opportunities in the play of the wagering game.

4. The method of claim 1, wherein the designated bet includes a raise.

5. The method of claim 1, which is provided through a data network.

6. The method of claim 5, wherein the data network is an internet.

7. A gaming system comprising:

a plurality of gaming devices, each gaming device including: at least one input device, at least one display device, at least one processor, and at least one memory device which stores a plurality of instructions, which when executed by the at least one processor, causes the at least one processor to operate with the at least one input device and the at least one display device to display at least one wagering game operable upon a wager by a player; and a controller, said gaming devices and said controller configured to:

(a) initiate a play of a wagering game for a plurality of players including at least two players, wherein said play of the wagering game is associated with a value;

(b) provide a plurality of opportunities at which designated bets can be made in said play of the wagering game, wherein each of said opportunities includes:

(i) enabling a first one of the players to make one of said designated bets, (ii) if said first one of the players makes one of said designated bets, enabling a second one of the players to accept or reject the designated bet made by the first one of the players, (iii) if the second one of the players accepts the designated bet made by the first one of the players, increasing the value associated with the play of the wagering game and enabling each of the players to continue participating in said play of the wagering game, and (iv) if the second one of the players rejects the designated bet made by the first one of the players, not increasing the value associated the play of the wagering game and enabling each of the players to continue participating in said play of the wagering game; and (c) after a final one of said opportunities, determine which of the players participating in the play of the wagering game is a winning player and provide an award to the winning player based on the value associated with the play of the wagering game after said final one of the opportunities.

8. The gaming system of claim 7, wherein said gaming devices and said controller are configured, if the first one of the players makes one of said designated bets at a first one of said opportunities and the second one of the players rejects the designated bet made by the first one of the players, to not enable said second one of the players to reject another designated bet made in said play of the game until the first one of the players rejects a designated bet made at a subsequent one of the opportunities.

9. The gaming system of claim 7, wherein in said gaming devices and said controller are configured to provide an indication to inform said players which player is enabled to reject the designated bet at each of said opportunities in the play of the wagering game.

10. The gaming system of claim 7, wherein the designated bet includes a raise.

11. A memory device which stores a plurality of instructions, which when executed by a controller causes the controller to operate with a plurality of gaming devices to:

(a) initiate a play of a wagering game for a plurality of players including at least two players, wherein said play of the wagering game is associated with a value;

(b) provide a plurality of opportunities at which designated bets can be made in said play of the wagering game, wherein each of said opportunities includes:

(i) enablng a first one of the players to make one of said designated bets, (ii) if said first one of the players makes one of said designated bets, enabling a second one of the players to accept or reject the designated bet made by the first one of the players, (iii) if the second one of the players accepts the designated bet made by the first one of the players, increasing the value associated with the play of the wagering game and enabling each of the players to continue participating in said play of the wagering game, and (iv) if the second one of the players rejects the designated bet made by the first one of the players, not increasing the value associated the play of the wagering game and enabling each of the players to continue participating in said play of the wagering game; and (c) after a final one of said opportunities, determine which of the players participating in the play of the wagering game is a winning player and provide an award to the winning player based on the value associated with the play of the wagering game after said final one of the opportunities.

12. The memory device of claim 11, wherein the plurality of instructions, when executed by the controller causes the controller to operate with the plurality of gaming devices, if the first one of the players makes one of said designated bets at a first one of said opportunities and the second one of the players rejects the designated bet made by the first one of the players, to not enable said second one of the players to reject another designated bet made in said play of the game until the first one of the players rejects a designated bet made at a subsequent one of the opportunities.

13. The memory device of claim 11, wherein the plurality of instructions, when executed by the controller causes the controller to operate with the plurality of gaming devices to provide an indication to inform said players which player is enabled to reject the designated bet at each of said opportunities in the play of the wagering game.

14. The memory device of claim 11, wherein the designated bet includes a raise.

* * * * *

UNITED STATES PATENT AND TRADEMARK OFFICE

CERTIFICATE OF CORRECTION

PATENT NO. : 8,342,954 B2
APPLICATION NO. : 13/311694
DATED : January 1, 2013
INVENTOR(S) : Michael M. Oberberger et al.

It is certified that error appears in the above-identified patent and that said Letters Patent is hereby corrected as shown below:

IN THE CLAIMS

In Claim 2, Column 30, Line 51, after “another” insert --one of the--.
In Claim 2, Column 30, Line 52, replace “bet” with --bets-- and between “the” and “game” insert --wagering--.
In Claim 2, Column 30, Line 53, replace “a designated bet” with --one of the designated bets--.
In Claim 3, Column 30, Line 57, between “reject” and “the” insert --one of-- and replace “bet” with --bets--.
In Claim 8, Column 31, Line 44, after “another” insert --one of the--.
In Claim 8, Column 31, Line 45, replace “bet” with --bets--.
In Claim 8, Column 31, Line 46, replace “a designated bet” with --one of the designated bets--.
In Claim 9, Column 31, Line 48, delete “in”.
In Claim 9, Column 31, Line 50, after “reject” insert --one of--.
In Claim 9, Column 31, Line 51, replace “bet” with --bets--.
In Claim 11, Column 32, Line 4, replace “causes” with --cause--.
In Claim 11, Column 32, Line 12, replace “enablng” with --enabling--.
In Claim 12, Column 32, Line 35, replace “causes” with --cause--.
In Claim 12, Column 32, Line 41, between “another” and “designated” insert --one of the-- and replace “bet” with --bets--.
In Claim 12, Column 32, Line 42, replace “a designated bet” with --one of the designated bets--.
In Claim 13, Column 32, Line 45, replace “causes” with --cause--.
In Claim 13, Column 32, Line 48, between “reject” and “the” insert --one of the-- and replace “bet” with --bets--.

Signed and Sealed this
Twenty-third Day of July, 2013

Teresa Stanek Rea
*Acting Director of the United States Patent and Trademark Office*